US011004455B2

(12) United States Patent
Murtaza et al.

(10) Patent No.: US 11,004,455 B2
(45) **Date of Patent: *May 11, 2021**

(54) APPARATUS AND METHOD FOR PROCESSING AN ENCODED AUDIO SIGNAL

(71) Applicant: Fraunhofer-Gesellschaft zur Foerderung der angewandten Forschung e.V., Munich (DE)

(72) Inventors: Adrian Murtaza, Craiova (RO); Jouni Paulus, Nuremberg (DE); Harald Fuchs, Roettenbach (DE); Roberta Camilleri, Fuerth (DE); Leon Terentiv, Erlangen (DE); Sascha Disch, Fuerth (DE); Juergen Herre, Erlangen (DE); Oliver Hellmuth, Budenhof (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/693,084

(22) Filed: Nov. 22, 2019

(65) Prior Publication Data

US 2020/0194012 A1 Jun. 18, 2020

Related U.S. Application Data

(63) Continuation of application No. 16/197,299, filed on Nov. 20, 2018, now Pat. No. 10,529,344, which is a (Continued)

(30) Foreign Application Priority Data

Feb. 2, 2015 (EP) ..... 15153486

(51) Int. Cl.
*H04S 3/00* (2006.01)
*G10L 19/008* (2013.01)
*G10L 19/16* (2013.01)

(52) U.S. Cl.
CPC ..... *G10L 19/008* (2013.01); *H04S 3/008* (2013.01); *G10L 19/167* (2013.01); *H04S 2400/03* (2013.01); *H04S 2400/11* (2013.01)

(58) Field of Classification Search
CPC ..... G10L 19/008; G10L 25/48; H04R 29/008; H04S 2400/11; H04S 2400/13; H04S 3/008; H04S 7/30
See application file for complete search history.

(56) References Cited

U.S. PATENT DOCUMENTS

2005/0114121 A1* 5/2005 Tsingos ..... H04S 7/30 704/220
2006/0089895 A1 4/2006 Joye et al.
(Continued)

FOREIGN PATENT DOCUMENTS

CN 101479785 A 7/2009
CN 102160113 A 8/2011
(Continued)

OTHER PUBLICATIONS

Blauert, J., "Spatial Hearing—The Psychophysics of Human Sound Localization", Revised Edition,The MIT Press, London, 1997, 1 page (Abstract).
(Continued)

*Primary Examiner* — Kile O Blair
(74) *Attorney, Agent, or Firm* — Michael A. Glenn; Perkins Coie LLP

(57) ABSTRACT

An apparatus for processing an encoded audio signal having a plurality of downmix signals associated with a plurality of input audio objects and object parameters. The apparatus
(Continued)

includes a grouper configured to group the downmix signals into groups of downmix signals associated with a set of input audio objects. The apparatus includes a processor configured to perform at least one processing step individually on the object parameters of each set of input audio objects in order to provide group results. Further, there is a combiner configured to combine the group results or processed group results in order to provide a decoded audio signal. The invention also refers to a corresponding method.

17 Claims, 17 Drawing Sheets

Related U.S. Application Data continuation of application No. 15/656,301, filed on Jul. 21, 2017, now Pat. No. 10,152,979, which is a continuation of application No. PCT/EP2016/052037, filed on Feb. 1, 2016.

(56) References Cited

U.S. PATENT DOCUMENTS

| | | | | |
|---|---|---|---|---|
| 2010/0042446 | A1 | 2/2010 | Volz et al. | |
| 2010/0094631 | A1* | 4/2010 | Engdegard | G10L 19/008 704/258 |
| 2012/0134511 | A1 | 5/2012 | Vilermo et al. | |
| 2014/0025386 | A1* | 1/2014 | Xiang | G10L 19/008 704/500 |
| 2014/0350944 | A1 | 11/2014 | Jot et al. | |
| 2014/0358567 | A1 | 12/2014 | Koppens et al. | |
| 2015/0131800 | A1 | 5/2015 | Mundt et al. | |
| 2015/0194158 | A1 | 7/2015 | Oh et al. | |
| 2015/0348564 | A1* | 12/2015 | Paulus | G10L 19/265 704/500 |
| 2016/0104491 | A1 | 4/2016 | Lee et al. | |
| 2016/0267914 | A1* | 9/2016 | Hu | G10L 19/02 |
| 2017/0180905 | A1* | 6/2017 | Purnhagen | G10L 19/008 |
| 2017/0339506 | A1* | 11/2017 | Chen | H04S 3/008 |
| 2019/0108847 | A1 | 4/2019 | Murtaza et al. | |

FOREIGN PATENT DOCUMENTS

| | | | |
|---|---|---|---|
| CN | 104054126 | A | 9/2014 |
| CN | 104285253 | A | 1/2015 |
| EP | 2535892 | B1 | 8/2014 |
| EP | 2830048 | A1 | 1/2015 |
| JP | 6564068 | B2 | 8/2019 |
| RU | 2417459 | C2 | 4/2011 |
| TW | 201419266 | A | 5/2014 |
| WO | 2007004829 | A2 | 1/2007 |
| WO | 2010105695 | A1 | 9/2010 |
| WO | 2010125104 | A1 | 11/2010 |
| WO | 2014021588 | A1 | 2/2014 |
| WO | 2014053547 | A1 | 4/2014 |
| WO | 2014175669 | A1 | 10/2014 |

OTHER PUBLICATIONS

Engdegard, Jonas et al., "Spatial Audio Object Coding (SAOC)—The Upcoming MPEG Standard on Parametric Object Based Audio Coding", 124th AES Convention, Audio Engineering Society, Paper 7377, May 17, 2008, pp. 1-15.

Faller, et al., "Binaural Cue Coding—Part II: Schemes and Applications", IEEE Transactions on Speech and Audio Processing, vol. 11, No. 6, Nov. 2003, pp. 520-531.

Faller, Christof, "Parametric Joint-Coding of Audio Sources", AES Convention Paper 6752, Presented at the 120th Convention, Paris, France, May 20-23, 2006, 12 pages.

Girin, L et al.,"Informed audio source separation from compressed linear stereo mixtures", AES 42nd International Conference: Semantic Audio, <hal-00695724>, Jul. 2011, pp. 159-168.

Herre, et al., "From SAC to SAOC—Recent Developments in Parametric Coding of Spatial Audio", Illusions in Sound, AES 22nd UK Conference, Apr. 2007, 8 pages.

Herre, J. "MPEG-H Audio—The New Standard for Universal Spatial / 3D Audio Coding", 137th AES Convention, 2011, 12 pages.

ISO/IEC, "Information Technology—MPEG Audio Technologies—Part 1: MPEG Surround", ISO/IEC 23003-1:2007(E), Feb. 15, 2007, 288 pages.

ISO/IEC, "Informational Technology—MPEG audio technologies Part 2: Spatial Audio Object Coding (SAOC)", ISO/IEC 23003-2 1st Edition Oct. 1, 2010, Oct. 1, 2010, 138 pages.

ISO/IEC CD 23008-3, "Information technology—High efficiency coding and media delivery in heterogeneous environments—Part 3: 3D audio", ISO/IEC JTC 1/SC 29/WG 11;, Apr. 4, 2014, 338 pages.

ISO/IEC DIS 23008-3, "Information technology—High efficiency coding and media delivery in heterogeneous environments—Part 3: 3D audio", ISO/IEC JTC 1/SC 29/WG 11;, Jul. 25, 2014, 435 pages.

ISO/IEC FDIS 23003-2:2010 (E), "Information technology—MPEG audio technologies—Part 2: Spatial Audio Object Coding (SAOC)", ISO/IEC JTC 1/SC 29/WG11, Mar. 10, 2010, 142 pages.

Liutkus, A. et al., "Informed source separation through spectrogram coding and data embedding", Signal Processing, Elsevier, 2012, 92 (8), Nov. 23, 2011, pp. 1937-1949.

Murtaza, A. et al., "Further information on open issues in SAOC 3D", ISO/IEC JTC1/SC29/WG11 MPEG2015/M35897; Fraunhofer IIS, Feb. 11, 2015, 8 pages.

Ozerov, et al., "Informed source separation: source coding meets source separation", IEEE Workshop on Applications of Signal Processing to Audio and Acoustics; Mohonk, NY, Oct. 2011, 5 pages.

Parvaix, et al., "Informed Source Separation of underdetermined instantaneous Stereo Mixtures using Source Index Embedding", IEEE ICASSP, 2010, Mar. 2010, pp. 245-248.

Parvaix, Mathieu et al., "A Watermarking-Based Method for Informed Source Separation of Audio Signals With a Single Sensor", IEEE Transactions on Audio, Speech and Language Processing, vol. 18, No. 6, May 26, 2010, pp. 1464-1475.

Vilkamo, Juha et al., "Optimized covariance domain framework for time-frequency processing of spatial audio", Journal of the Audio Engineering Society, vol. 61, No. 6, Jun. 2013, pp. 403-411.

Zhang, Shuhua et al., "An informed source separation system for speech signals", 12th Annual Conference of the International Speech Communication Association (Interspeech 2011), Aug. 2011, pp. 573-576.

Hui, Li , et al., IEEE Signal Processing Letters vol. 21, issue 8—Hui Li, "A Time-Frequency Hybrid Downmixing Methos for AC-3 Decoding"; pp. 933-936; Aug. 8, 2014, Aug. 8, 2014.

* cited by examiner

```
#define SAOC_MAX_OBJECTS                128
#define SAOC_MAX_DMX_CHANNELS           32

#define SAOC_MAX_GROUP_OBJECTS          32  /* Maximum number of objects in one group */

#define SAOC_MAX_ GROUP_DMX_CHANNELS    16  /* Maximum number of downmix channels in one group */

typedef struct saocCoreGroupList {
  int numDmx;
  int numObj;
  int dmxList[SAOC_MAX_DMX_CHANNELS];
  int objList[SAOC_MAX_OBJECTS];
} saocCoreGroupList;

typedef struct saocCoreGroup {
  int numGroups;
  saocCoreGroupList saocGroup[SAOC_MAX_DMX_CHANNELS];
} saocCoreGroup;

static int getSaocCoreGroups(int CrossCov[SAOC_MAX_DMX_CHANNELS][SAOC_MAX_OBJECTS],
                             int numObjects,
                             int numDmxChannels,
                             saocCoreGroup *groupInfo)
{
  int iGr, iObj, jObj, iDmx, jDmx, indexObj, indexChan, groupIndex, foundGroup;

  int channelsFlag[SAOC_MAX_DMX_CHANNELS];
  int objectsFlag[SAOC_MAX_OBJECTS];

  /* Init empty grouping info */
  for (iGr = 0; iGr<SAOC_MAX_DMX_CHANNELS; iGr++) {
    for (iObj = 0; iObj < numObjects; iObj++){
      groupInfo->saocGroup[iGr].objList[iObj] = -1;
    }
    for (iDmx = 0; iDmx <SAOC_MAX_DMX_CHANNELS; iDmx++) {
      groupInfo->saocGroup[iGr].dmxList[iDmx] = -1;
    }
    groupInfo->saocGroup[iGr].numDmx = 0;
    groupInfo->saocGroup[iGr].numObj = 0;
  }
  groupInfo->numGroups = 0;

  for (iObj = 0; iObj < numObjects; iObj++){
    objectsFlag[iObj] = -1;
  }
  for (jDmx = 0; jDmx <numDmxChannels; jDmx++) {
    channelsFlag[jDmx] = jDmx;
  }
```

Fig. 9A

```
for (iDmx = 0; iDmx <numDmxChannels; iDmx++) {
 for (iObj = 0; iObj < numObjects; iObj++) {          /* search for not assigned objects */
  if (CrossCov[iDmx][iObj]>0) {
   if (objectsFlag[iObj] == -1) {                      /* iObj not assigned to any group */
    objectsFlag[iObj] = iDmx;                          /* assign iObj to iDmx group*/
   } else {                                            /* iObj already assigned to a group*/
foundGroup = objectsFlag[iObj];
for (jObj = 0; jObj < numObjects; jObj++) {            /* assign all objects from this existing
                                                       group to the new one */
  if (objectsFlag[jObj] == foundGroup) {
  objectsFlag[jObj] = iDmx;
 }
}
for (jDmx = 0; jDmx <iDmx; jDmx++) {                   /* assign all channels from this existing
                                                       group to the new one */
 if (channelsFlag[jDmx] == foundGroup) {
  channelsFlag[jDmx] = iDmx;
      }
     }
    }
   }
  }
 }
for (iObj = 0; iObj < numObjects; iObj++) {
  iGr = groupInfo->numGroups;
  if (objectsFlag[iObj] > -1) {                        /* object not assigned to any group */
   groupIndex = objectsFlag[iObj];
   for (jObj = 0; jObj < numObjects; jObj++) {         /* assign all objects from this group
                                                        into the object list */
    if (objectsFlag[jObj] == groupIndex) {
 indexObj = groupInfo->saocGroup[iGr].numObj++;
 groupInfo->saocGroup[iGr].objList[indexObj] = jObj;
 objectsFlag[jObj] = -1;                               /* mark object as assigned to an object
                                                        list */
    }
   }
   for (iDmx = 0; iDmx <numDmxChannels; iDmx++) {      /* assign all chnls from this group into
                                                       the list */
    if (channelsFlag[iDmx] == groupIndex) {
     indexChan = groupInfo->saocGroup[iGr].numDmx++;
     groupInfo->saocGroup[iGr].dmxList[indexChan] = iDmx;
     channelsFlag[iDmx] = -1;                          /* mark channel as assigned to a channel
                                                       list */
    }
   }
   groupInfo->numGroups++;
  }
}
```

Fig. 9B

```
  for (iGr = 0; iGr<groupInfo->numGroups; iGr++) {
    assert(groupInfo->saocGroup[iGr].numDmx < SAOC_MAX_GROUP_DMX_CHANNELS);
    assert(groupInfo->saocGroup[iGr].numObj < SAOC_MAX_GROUP_OBJECTS);
  }

  return 0;
}

static void getSaocDmxPossitions(float Dmx[SAOC_MAX_DMX_CHANNELS][SAOC_MAX_OBJECTS],
                                 int RelatedToMatrix[SAOC_MAX_OBJECTS][SAOC_MAX_OBJECTS],
                                 int CrossCov[SAOC_MAX_DMX_CHANNELS][SAOC_MAX_OBJECTS],
                                 int numObjects,
                                 int firstObject,
                                 int numDmxChannels,
                                 int firstDmxChannel)
{
  int ch, dCh, obj, obj2, objIdx, objIdx2;
  int D[SAOC_MAX_DMX_CHANNELS][SAOC_MAX_OBJECTS] = {{0}};
  float minVal = (float)pow(10.0f,-150.0f/20.0f) + SAOC_EPSILON;

  for (ch=0; ch<numDmxChannels; ch++) {
    dCh = firstDmxChannel + ch;
    for (obj=0; obj<numObjects; obj++) {
      D[ch][obj] = (minVal<Dmx[dCh][firstObject + obj] ? 1 : 0);
    }
  }

  for (ch=0; ch<numDmxChannels; ch++) {
    dCh = firstDmxChannel + ch;
    for (obj=0; obj<numObjects; obj++) {
      objIdx = firstObject + obj;
      CrossCov[ch][obj] = 0.0f;
      for (obj2=0; obj2<numObjects; obj2++) {
        objIdx2 = firstObject + obj2;
        CrossCov[ch][obj] += D[ch][obj] * RelatedToMatrix[objIdx][objIdx2];
      }
    }
  }
}
static int getSaocCoreGrouping(float Dmx[][SAOC_MAX_OBJECTS],
                               int RelatedToMatrix[SAOC_MAX_OBJECTS][SAOC_MAX_OBJECTS],
                               int numObjects,
                               int numDmxChannels,
                               saocCoreGroup *groupInfo)
{
  int CrossCov[SAOC_MAX_DMX_CHANNELS][SAOC_MAX_OBJECTS] = {{0}};

  getSaocDmxPossitions(Dmx, RelatedToMatrix, CrossCov, numObjects, 0, numDmxChannels, 0);
  getSaocCoreGroups(CrossCov, numObjects, numDmxChannels, groupInfo);

  return 0;
}
```

Fig. 9C

APPARATUS AND METHOD FOR PROCESSING AN ENCODED AUDIO SIGNAL

CROSS-REFERENCE TO RELATED APPLICATIONS

This application is a continuation of copending U.S. patent application Ser. No. 16/197,299, filed on Nov. 20, 2018, which in turn is a continuation of copending U.S. patent application Ser. No. 15/656,301, filed on Jul. 21, 2017, now U.S. Pat. No. 10,152,979, which in turn is a continuation of copending International Application No. PCT/EP2016/052037, filed Feb. 1, 2016, which is incorporated herein by reference in its entirety, and additionally claims priority from European Application No. EP 15 153 486.4, filed Feb. 2, 2015, which is incorporated herein by reference in its entirety.

BACKGROUND OF THE INVENTION

The invention refers to an apparatus and a method for processing an encoded audio signal.

Recently, parametric techniques for the bitrate-efficient transmission/storage of audio scenes containing multiple audio objects have been proposed in the field of audio coding (see the following references [BCC, JSC, SAOC, SAOC1, SAOC2]) and informed source separation (see e.g. the following references [ISS1, ISS2, ISS3, ISS4, ISS5, ISS6]).

These techniques aim at reconstructing a desired output audio scene or audio source objects based on additional side information describing the transmitted/stored audio signals and/or source objects in the audio scene. This reconstruction takes place in the decoder using a parametric informed source separation scheme.

Unfortunately, it has been found that in some cases the parametric separation schemes can lead to severe audible artifacts causing an unsatisfactory hearing experience.

SUMMARY

According to an embodiment, an apparatus for processing an encoded audio signal including a plurality of downmix signals associated with a plurality of input audio objects and object parameters E may have: a grouper configured to group said plurality of downmix signals into a plurality of groups of downmix signals associated with a set of input audio objects of said plurality of input audio objects, a processor configured to perform at least one processing step individually on the object parameters $E_k$ of each set of input audio objects in order to provide group results, and a combiner configured to combine said group results or processed group results in order to provide a decoded audio signal.

According to another embodiment, a method for processing an encoded audio signal including a plurality of downmix signals associated with a plurality of input audio objects and object parameters E may have the steps of: grouping said downmix signals into a plurality of groups of downmix signals associated with a set of input audio objects of said plurality of input audio objects, performing at least one processing step individually on the object parameters $E_k$ of each set of input audio objects in order to provide group results, and combining said group results in order to provide a decoded audio signal.

The grouper is configured to group the plurality of downmix signals into a plurality of groups of downmix signals.

Each group of downmix signals is associated with a set of input audio objects (or input audio signals) of the plurality of input audio objects. In other words: the groups cover sub-sets of the set of the input audio signals represented by the encoded audio signal. Each group of downmix signals is also associated with some of the object parameters E describing the input audio objects. In the following, the individual groups $G_k$ are identified with an index k with $1 \leq k \leq K$ with K as the number of groups of downmix signals.

Further, the processor—following the grouping—is configured to perform at least one processing step individually the object parameters of each set of input audio objects. Hence, at least one processing step is performed not simultaneously on all object parameters but individually on the object parameters belonging to the respective group of downmix signals. In one embodiment just one step is performed individually. In a different embodiment more than one step is performed, whereas in an alternative embodiment, the entire processing is performed individually on the groups on downmix signals. The processor provides group results for the individual groups.

In a different embodiment, the processor—following the grouping—is configured to perform at least one processing step individually on each group of the plurality of groups of downmix signals. Hence, at least one processing step is performed not simultaneously on all downmix signals but individually on the respective groups of downmix signals.

Eventually, the combiner is configured to combine the group results or processed group results in order to provide a decoded audio signal. Hence, the group results or the results of further processing steps performed on the group results are combined to provide a decoded audio signal. The decoded audio signal corresponds to the plurality of input audio objects which are encoded by the encoded audio signal.

The grouping done by the grouper is done at least under the constriction that each input audio object of the plurality of input audio objects belongs to just or exactly one set of input audio objects. This implies that each input audio object belongs to just one group of downmix signals. This also implies that each downmix signal belongs to just one group of downmix signals.

According to an embodiment, the grouper is configured to group the plurality of downmix signals into the plurality of groups of downmix signals so that each input audio object of each set of input audio objects either is free from a relation signaled in the encoded audio signal with other input audio objects or has a relation signaled in the encoded audio signal only with at least one input audio object belonging to the same set of input audio objects. This implies that no input audio object has a signaled relation to an input audio object belonging to a different group of downmix signals. Such a signaled relation is in one embodiment that two input audio objects are the stereo signals stemming from one single source.

The inventive apparatus processes an encoded audio signal comprising downmix signals. Downmixing is a part of the process of encoding a given number of individual audio signals and implies that a certain number of input audio objects is combined into a downmixing signal. The number of input audio objects is, thus, reduced to a smaller number of downmix signals. Due to this are the downmix signals associated with a plurality of input audio objects.

The downmix signals are grouped into groups of downmix signals and are subjected individually—i.e. as single groups—to at least one processing step. Hence, the apparatus performs at least one processing step not jointly on all downmix signals but individually on the individual groups of downmix signals. In a different embodiment the object parameters of the groups are treated separately in order to obtain the matrices to be applied to the encoded audio signal.

In one embodiment is the apparatus a decoder of encoded audio signals. The apparatus is in an alternative embodiment a part of a decoder.

In one embodiment, each downmix signal is attributed to one group of downmix signals and is, consequently, processed individually with respect to at least one processing step. In this embodiment the number of groups of downmix signals equals the number of downmix signals. This implies that the grouping and the individual processing coincide.

In one embodiment the combination is one of the final steps of the processing of the encoded audio signal. In a different embodiment, the group results are further subjected to different processing steps which are either performed individually or jointly on the group results.

The grouping (or the detection of the groups) and the individual treatment of the groups have shown to lead to an audio quality improvement. This especially holds, e.g., for parametric coding techniques.

According to an embodiment, the grouper of the apparatus is configured to group the plurality of downmix signals into the plurality of groups of downmix signals while minimizing a number of downmix signals within each group of downmix signals. In this embodiment, the apparatus tries to reduce the number of downmix signals belonging to each group. In one case, to at least one group of downmix signals belongs just one downmix signal.

According to an embodiment, the grouper is configured to group said plurality of downmix signals into said plurality of groups of downmix signals so that just one single downmix signal belongs to one group of downmix signals. In other words: The grouping leads to various groups of downmix signals wherein at least one group of downmix signal is given to which just one downmix signal belongs. Thus, at least one group of downmix signals refers to just one single downmix signal. In a further embodiment, the number of groups of downmix signals to which just one downmix signals belongs is maximized.

In one embodiment, the grouper of the apparatus is configured to group the plurality of downmix signals into the plurality of groups of downmix signals based on information within the encoded audio signal. In a further embodiment, the apparatus uses only information within the encoded audio signal for grouping the downmix signals. Using the information within the bitstream of the encoded audio signal comprises—in one embodiment—taking the correlation or covariance information into account. The grouper, especially, extracts from the encoded audio signal the information about the relation between different input audio objects.

In one embodiment, the grouper is configured to group said plurality of downmix signals into said plurality of groups of downmix signals based on bsRelatedTo-values within said encoded audio signal. Concerning these values refer, for example, to WO 2011/039195 A1.

According to an embodiment, the grouper is configured to group the plurality of downmix signals into the plurality of groups of downmix signals by applying at least the following steps (to each group of downmix signals):

detecting whether a downmix signal is assigned to an existing group of downmix signals;

detecting whether at least one input audio object of the plurality of input audio objects associated with the downmix signal is part of a set of input audio objects associated with an existing group of downmix signals;

assigning the downmix signal to a new group of downmix signals in case the downmix signal is free from an assignment to an existing group of downmix signals (hence, the downmix signal is not already assigned to a group) and in case all input audio objects of the plurality of input audio objects associated with the downmix signal are free from an association with an existing group of downmix signals (hence, the input audio objects of the downmix signal are not already—via a different downmix signal—assigned to a group); and combining the downmix signal with an existing group of downmix signals either in case the downmix signal is assigned to the existing group of downmix signals or in case at least one input audio object of the plurality of input audio objects associated with the downmix signal is associated with the existing group of downmix signals.

If a relation signaled in the encoded audio signal is also taken into account, then another detecting step will be added leading to an addition requirement for assigning and combining the downmix signals.

According to an embodiment, the processor is configured to perform various processing steps individually on the object parameters ($E_k$) of each set of input audio objects (or of each group of downmix signals) in order to provide individual matrices as group results. The combiner is configured to combine the individual matrices in order to provide said decoded audio signal. The object parameters ($E_k$) belong to the input audio objects of the respective group of downmix signals with index k and are processed to obtain individual matrices for this group having index k.

According to a different embodiment, the processor is configured to perform various processing steps individually on each group of said plurality of groups of downmix signals in order to provide output audio signals as group results. The combiner is configured to combine the output audio signals in order to provide said decoded audio signal.

In this embodiment the groups of downmix signals are such processed that the output audio signals are obtained which correspond to the input audio objects belonging to the respective group of downmix signals. Hence, combining the output audio signals to the decoded audio signals is close to the final steps of the decoding processes performed on the encoded audio signal. In this embodiment, thus, each group of downmix signals is individually subjected to all processing steps following the detection of the groups of downmix signals.

In a different embodiment, the processor is configured to perform at least one processing step individually on each group of said plurality of groups of downmix signals in order to provide processed signals as group results. The apparatus further comprises a post-processor configured to process jointly said processed signals in order to provide output audio signals. The combiner is configured to combine the output audio signals as processed group results in order to provide said decoded audio signal.

In this embodiment the groups of downmix signal are subjected to at least one processing step individually and to at least one processing step jointly with other groups. The individual processing leads to processed signals which—in an embodiment—are processed jointly.

Referring to the matrices, in one embodiment, the processor is configured to perform at least one processing step individually on the object parameters ($E_k$) of each set of input audio objects in order to provide individual matrices. A post-processor comprised by the apparatus is configured to process jointly object parameters in order to provide at least one overall matrix. The combiner is configured to combine said individual matrices and said at least one overall matrix. In one embodiment the post-processors performs at least one processing step jointly on the individual matrices in order to obtain at least one overall matrix.

The following embodiments refer to processing steps performed by the processor. Some of these steps are also suitable for the post-processor mentioned in the foregoing embodiment.

In one embodiment, the processor comprises an un-mixer configured to un-mix the downmix signals of the respective groups of said plurality of groups of downmix signals. By un-mixing the downmix signals the processor obtains representations of the original input audio objects which were down-mixed into the downmix signal.

According to an embodiment, the un-mixer is configured to un-mix the downmix signals of the respective groups of said plurality of groups of downmix signals based on a Minimum Mean Squared Error (MMSE) algorithm. Such an algorithm will be explained in the following description.

In a different embodiment, wherein the processor comprises an un-mixer configured to process the object parameters of each set of input audio objects individually in order to provide individual un-mix matrices.

In one embodiment, the processor comprises a calculator configured to compute individually for each group of downmix signals matrices with sizes depending on at least one of a number of input audio objects of the set of input audio objects associated with the respective group of downmix signals and a number of downmix signals belonging to the respective group of downmix signals. As the groups of downmix signals are smaller than the entire ensemble of downmix signals and as the groups of downmix signals refer to smaller numbers of input audio signals, the matrices used for the processing of the groups of downmix signals are smaller than these used in the state of art. This facilitates the computation.

According to an embodiment, the calculator is configured to compute for the individual unmixing matrices an individual threshold based on a maximum energy value within the respective group of downmix signals.

According to an embodiment, the processor is configured to compute an individual threshold based on a maximum energy value within the respective group of downmix signals for each group of downmix signals individually.

In one embodiment, the calculator is configured to compute for a regularization step for un-mixing the downmix signals of each group of downmix signals an individual threshold based on a maximum energy value within the respective group of downmix signals. The thresholds for the groups of downmix signals are computed in a different embodiment by the un-mixer itself.

The following discussion will show the interesting effect of computing the threshold for the groups (one threshold for each group) and not for all downmix signals.

According to an embodiment, the processor comprises a renderer configured to render the un-mixed downmix signals of the respective groups for an output situation of said decoded audio signal in order to provide rendered signals. The rendering is based on input provided by the listener or based on data about the actual output situation.

In an embodiment, the processor comprises a renderer configured to process the object parameters in order to provide at least one render matrix.

The processor comprises in an embodiment a post-mixer configured to process the object parameters in order to provide at least one decorrelation matrix.

According to an embodiment, the processor comprises a post-mixer configured to perform at least one decorrelation step on said rendered signals and configured to combine results ($Y_{wet}$) of the performed decorrelation step with said respective rendered signals ($Y_{dry}$).

According to an embodiment, the processor is configured to determine an individual downmixing matrix ($D_k$) for each group of downmix signals (k being the index of the respective group), the processor is configured to determine an individual group covariance matrix ($E_k$) for each group of downmix signals, the processor is configured to determine an individual group downmix covariance matrix ($\Delta_k$) for each group of downmix signals based on the individual downmixing matrix ($D_k$) and the individual group covariance matrix ($E_k$), and the processor is configured to determine an individual regularized inverse group matrix ($J_k$) for each group of downmix signals.

According to an embodiment, the combiner is configured to combine the individual regularized inverse group matrices ($J_k$) to obtain an overall regularized inverse group matrix (J).

According to an embodiment, the processor is configured to determine an individual group parametric un-mixing matrix ($U_k$) for each group of downmix signals based on the individual downmixing matrix ($D_k$), the individual group covariance matrix ($E_k$), and the individual regularized inverse group matrix ($J_k$), and the combiner is configured to combine the an individual group parametric un-mixing matrix ($U_k$) to obtain an overall group parametric unmixing matrix (U).

According to an embodiment, the processor is configured to determine an individual group parametric un-mixing matrix ($U_k$) for each group of downmix signals based on the individual downmixing matrix ($D_k$), the individual group covariance matrix ($E_k$), and the individual regularized inverse group matrix ($J_k$), and the combiner is configured to combine the individual group parametric un-mixing matrix ($U_k$) to obtain an overall group parametric unmixing matrix (U).

According to an embodiment, the processor is configured to determine an individual group rendering matrix ($R_k$) for each group of downmix signals.

According to an embodiment, the processor is configured to determine an individual upmixing matrix ($R_kU_k$) for each group of downmix signals based on the individual group rendering matrix ($R_k$) and the individual group parametric un-mixing matrix ($U_k$), and the combiner is configured to combine the individual upmixing matrices ($R_kU_k$) to obtain an overall upmixing matrix (RU).

According to an embodiment, the processor is configured to determine an individual group covariance matrix ($C_k$) for each group of downmix signals based on the individual group rendering matrix ($R_k$) and the individual group covariance matrix ($E_k$), and the combiner is configured to combine the individual group covariance matrices ($C_k$) to obtain an overall group covariance matrix (C).

According to an embodiment, the processor is configured to determine an individual group covariance matrix of the parametrically estimated signal $(E_y^{dry})_k$ based on the individual group rendering matrix ($R_k$), the individual group parametric un-mixing matrix ($U_k$), the individual downmixing matrix ($D_k$), and the individual group covariance matrix ($E_k$), and the combiner is configured to combine the individual group covariance matrices of the parametrically estimated signal $(E_y^{dry})_k$ to obtain an overall parametrically estimated signal $E_y^{dry}$.

According to an embodiment, the processor is configured to determine a regularized inverse matrix (J) based on a singular value decomposition of a downmix covariance matrix ($E_{DMX}$).

According to an embodiment, the processor is configured to determine sub-matrix ($\Delta_k$) for a determination of a parametric un-mixing matrix (U), by selecting elements ($\Delta(m, n)$) corresponding to the downmix signals (m, n) assigned to the respective group (having index k) of downmix signals. Each group of downmix signals covers a specified number of downmix signals and an associated set of input audio objects and is denoted here by an index k.

According to this embodiment, the individual sub-matrices ($\Delta_k$) are obtained by selecting or picking the elements from the downmix covariance matrix $\Delta$ which belong to the respective group k.

In one embodiment, the individual sub-matrices ($\Delta_k$) are inverted individually and the results are combined in the regularized inverse matrix (J).

In a different embodiment, the sub-matrix ($\Delta_k$) are obtained using their definition as $\Delta_k=D_kE_kD_k^*$ with the individual the individual downmixing matrix ($D_k$)

According to an embodiment, the combiner is configured to determine a post-mixing matrix (P) based on the individually determined matrices for each group of downmix signals and the combiner is configured to apply the post-mixing matrix (P) to the plurality of downmix signals in order to obtain the decoded audio signal. In this embodiment, from the objects parameters a post-mixing matrix is computed which is applied to the encoded audio signal in order to obtain the decoded audio signal.

According to one embodiment, the apparatus and its respective components are configured to perform for each group of downmix signals individually at least one of the following computations:

- computation of group covariance matrix $E_k$ of size $N_k$ times $N_k$ with the elements: $e_{i,j}^k=\sqrt{OLD_i^k OLD_j^k}IOC_{i,j}^k$,
- computation of group downmix covariance matrix $\Delta_k$ of size $M_k$ times $M_k$: $\Delta_k=D_kE_kD_k^*$,
- computation of singular value decomposition of group downmix covariance matrix $\Delta_k=D_kE_kD_k^*$: $\Delta_k=V_k\ \Lambda_k\ V_k^*$,
- computation of the regularized inverse group matrix $J_k$ approximating $J_k\approx\Delta_k^{-1}$: $J_k=V_k\ \Lambda_k^{inv}V_k^*$, including the computation of the individual matrix $\Lambda^{inv}{}_k$ (details will be given below),
- computation of the group parametric un-mixing matrix $U_k$ of size $N_k$ times $M_k$: $U_k=E_kD_k^*J_k$,
- multiplication of the group rendering matrix $R_k$ of size $N_{Upmix}$ times $N_k$ with the un-mixing matrix $U_k$ of size $N_k$ times $M_k$: $R_kU_k$,
- computation of the group covariance matrix $C_k$ of size $N_{out}$ times $N_{out}$: $C_k=R_kE_kR_k^*$,
- computation of the group covariance of the parametrically estimated signal $(E_y^{dry})_k$ of size $N_{out}$ times $N_{out}$: $(E_Y^{dry})_k=R_kU_k\,(D_kE_kD^*_k)U^*_kR^*_k$.

In this respect, k denotes a group index of the respective group of downmix signals, $N_k$ denotes the number of input audio objects of the associated set of input audio objects, $M_k$ denotes the number of downmix signals belonging to the respective group of downmix signals, and $N_{out}$ denotes the number of upmixed or rendered output channels.

The computed matrices are in size smaller than those used in the state of art. Accordingly, in one embodiment as many as possible processing steps are performed individually on the groups of downmix signals.

The object of the invention is also achieved by a corresponding method for processing an encoded audio signal. The encoded audio signal comprises a plurality of downmix signals associated with a plurality of input audio objects and object parameters. The method comprises the following steps:

- grouping the downmix signals into a plurality of groups of downmix signals associated with a set of input audio objects of the plurality of input audio objects,
- performing at least one processing step individually on the object parameters of each set of input audio objects in order to provide group results, and
- combining said group results in order to provide a decoded audio signal.

The grouping is performed with at least the constriction that each input audio object of the plurality of input audio objects belongs to just one set of input audio objects.

The above mentioned embodiments of the apparatus can also be performed by steps of the method and corresponding embodiments of the method. Therefore, the explanations given for the embodiments of the apparatus also hold for the method.

BRIEF DESCRIPTION OF THE DRAWINGS

Embodiments of the present invention will be detailed subsequently referring to the appended drawings, in which:

FIG. 9C shows an example of an implementation of a group detection function.

DETAILED DESCRIPTION OF THE INVENTION

In the following an overview on parametric separation schemes will be given, using the example of MPEG Spatial Audio Object Coding (SAOC) technology ([SAOC]) and SAOC 3D processing part of MPEG-H 3D Audio ([SAOC3D, SAOC3D2]). The mathematical properties of these methods are considered.

The following mathematical notation is used:

N number of input audio objects (alternatively: input objects)

$N_{dmx}$ number of downmix (transport) channels $N_{out}$ number of upmix (rendered) channels $N_{samples}$ number of samples per audio signal D downmixing matrix, size $N_{dmx}$ times N S input audio object signal, size N times $N_{samples}$ E object covariance matrix, size N times N, approximating $E \approx SS^*$ X downmix audio signals, size $N_{dmx}$ times $N_{samples}$, defined as X=DS $E_{DMX}$ covariance matrix of the downmix signals, size $N_{dmx}$ times $N_{dmx}$, defined as $E_{DMX}=DED^*$ U parametric source estimation matrix, size N times $N_{dmx}$, which approximates $U \approx ED^*(DED^*)^{-1}$ R rendering matrix (specified at the decoder side), size $N_{out}$ times N $\hat{S}$ parametrically reconstructed object signals, size N times $N_{samples}$, which approximates S and is defined as $\hat{S}=UX$, $Y_{dry}$ parametrically reconstructed and rendered object signals, size $N_{out}$ times $N_{samples}$, defined as $Y_{dry}=RUX$ $Y_{wet}$ decorrelator outputs, size $N_{out}$ times $N_{samples}$ Y final output, size $N_{out}$ times $N_{samples}$ $(\bullet)^*$ self-adjoint (Hermitian) operator, which represents the conjugate transpose of $(\bullet)$ $F_{decorr}(\bullet)$ decorrelator function Without loss of generality, in order to improve readability of equations, for all introduced variables the indices denoting time and frequency dependency are omitted.

Parametric Object Separation Systems:

General parametric separation schemes aim to estimate a number of audio sources from signal mixture (downmix) using auxiliary parametric information. Typical solution of this task is based on application of the Minimum Mean Squared Error (MMSE) estimation algorithms. The SAOC technology is one example of such parametric audio coding systems.

Figure 1:
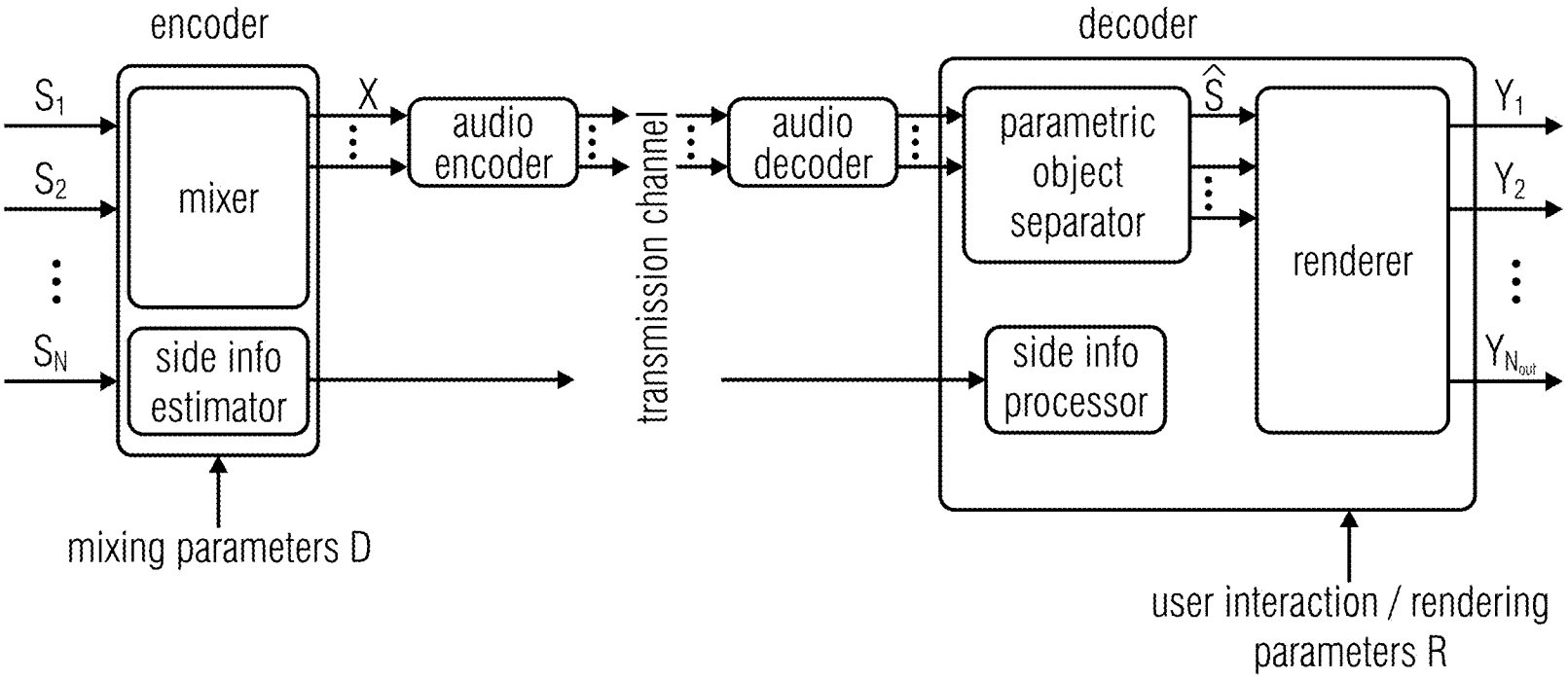
FIG. 1 shows an overview of an MMSE based parametric downmix/upmix concept.

FIG. 1 depicts the general principle of the SAOC encoder/decoder architecture.

The general parametric downmix/upmix processing is carried out in a time/frequency selective way and can be described as a sequence of the following steps:

- The "encoder" is provided with input "audio objects" S and "mixing parameters" D. The "mixer" down-mixes the "audio objects" S into a number of "downmix signals" X using "mixing parameters" D (e.g., downmixing gains).
- The "side info estimator" extracts the side information describing characteristics of the input "audio objects" S (e.g., covariance properties).
- The "downmix signals" X and side information are transmitted or stored. These downmix audio signals can be further compressed using audio coders (such as MPEG-1/2 Layer II or III, MPEG-2/4 Advanced Audio Coding (AAC), MPEG Unified Speech and Audio Coding (USAC), etc.). The side information can be also represented and encoded efficiently (e.g., as coded relations of the object powers and object correlation coefficients).

The "decoder" restores the original "audio objects" from the decoded "downmix signals" using the transmitted side information (this information provides the object parameters). The "side info processor" estimates the un-mixing coefficients to be applied on the "downmix signals" within "parametric object separator" to obtain the parametric object reconstruction of S. The reconstructed "audio objects" are rendered to a (multi-channel) target scene, represented by the output channels Y, by applying a "rendering parameters" R.

Same general principle and sequential steps are applied in SAOC 3D processing, which incorporates an additional decorrelation path.

Figure 2:
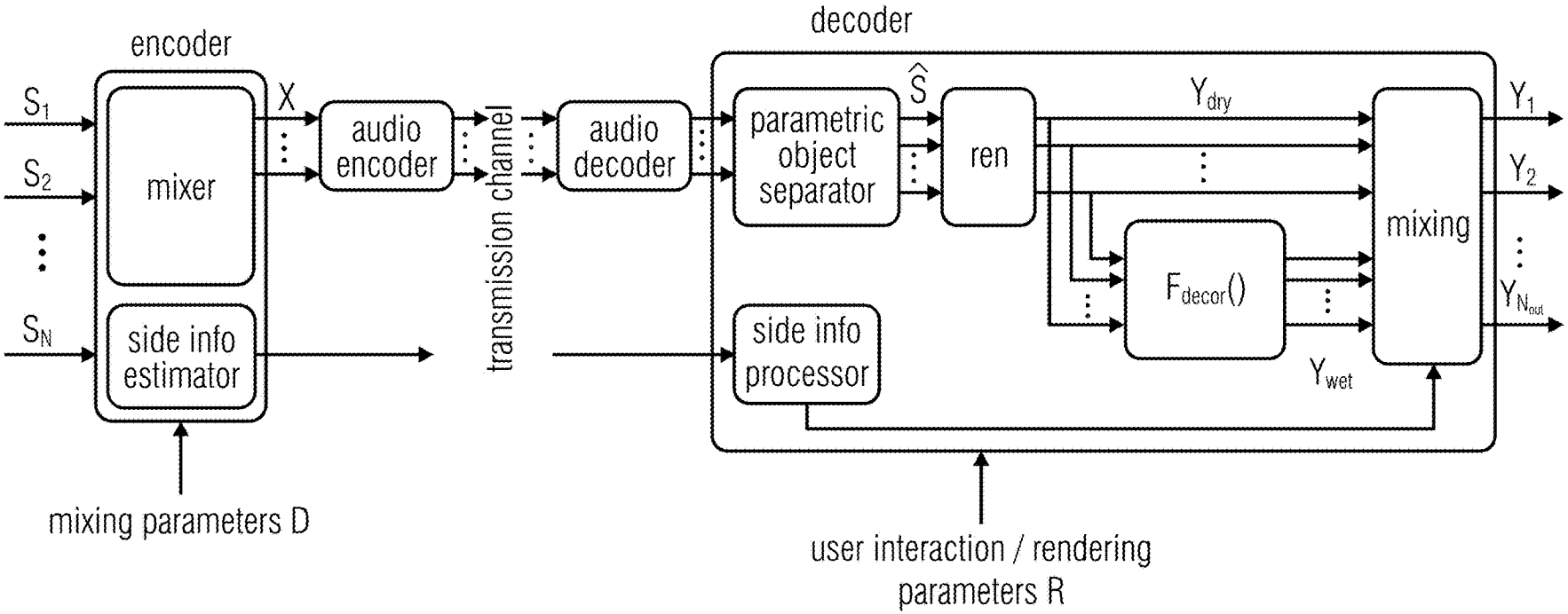
FIG. 2 shows a parametric reconstruction system with decorrelation applied on rendered output.

FIG. 2 provides an overview of the parametric downmix/upmix concept with integrated decorrelation path.

Using the example of SAOC 3D technique, part of MPEG-H 3D Audio, the main processing steps of such a parametric separation system can be summarized as follows:

The SAOC 3D decoder produces the modified rendered output Y as a mixture of the parametrically reconstructed and rendered signal (dry signal) $Y_{dry}$ and its decorrelated version (wet signal) $Y_{wet}$.

Figure 3:
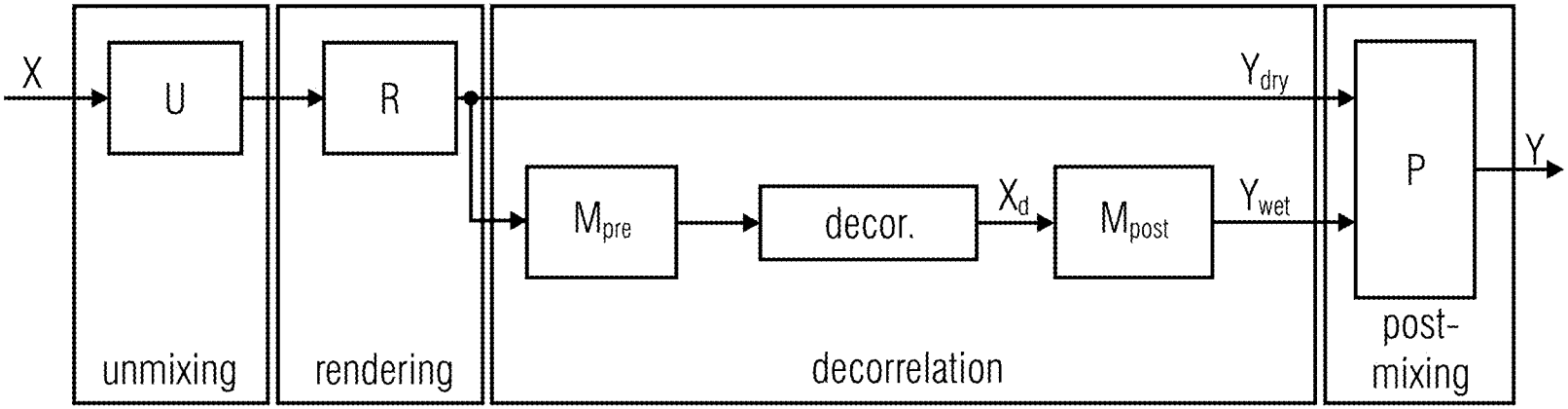
FIG. 3 shows a structure of a downmix processor.

The—for the discussion of the invention relevant—processing steps can be differentiated as illustrated in FIG. 3:

- Un-mixing, which parametrically reconstructs the input audio objects using matrix U,
- Rendering using rendering information (matrix R),
- Decorrelation,
- Post-mixing using matrix P, computed based on information contained in the bitstream.

The parametric object separation is obtained from the downmix signal X using the un-mixing matrix U based on the additional side information: $\hat{S}=UX$.

The rendering information R is used to obtain the dry signal as: $Y_{dry}=R\hat{S}=RUX$.

The final output signal Y is computed from the signals $Y_{dry}$ and $Y_{wet}$ as $$Y = P\begin{bmatrix} Y_{dry} \\ Y_{wet} \end{bmatrix}.$$

The mixing matrix P is computed, for example, based on rendering information, correlation information, energy information, covariance information, etc.

In the invention, this will be the post-mixing matrix applied to the encoded audio signal in order to obtain the decoded audio signal.

In the following, the common parametric object separation operation using MMSE will be explained.

The un-mixing matrix U is obtained based on information derived from variables contained in the bitstream (for example the downmixing matrix D and the covariance information E), using the Minimum Mean Squared Error (MMSE) estimation algorithm: U=ED*J.

The matrix J of size $N_{dmx}$ times $N_{dmx}$ represents an approximation of the pseudo-inverse of the downmix covariance matrix $E_{DMX}=DED^*$ as: $J \approx E_{DMX}^{-1}$.

The computation of the matrix J is derived according to: $J=V\,\Lambda^{inv}\,V^*$, where the matrices V and Λ are determined using the singular value decomposition (SVD) of the matrix $E_{DMX}$ as: $E_{DMX}=V\,\Lambda\,V^*$.

To be noted that similar results can be obtained using different decomposition methods such as: eigenvalue decomposition, Schur decomposition, etc.

The regularized inverse operation $(\bullet)^{inv}$, used for the diagonal singular value matrix Λ, can be determined, for example, as done in SAOC 3D, using a truncation of the singular values relative to the highest singular value:

$$\Lambda^{inv}=\lambda_{i,j}^{-1}=\begin{cases}\dfrac{1}{\lambda_{i,i}} & i=j \text{ and } \lambda_{i,i}\geq T_{reg}^{\Lambda},\\ 0 & \text{otherwise.}\end{cases}$$

In a different embodiment, the following formula is used:

$$\Lambda^{inv}=\lambda_{i,j}^{-1}=\begin{cases}\dfrac{1}{\lambda_{i,i}} & i=j \text{ and } \mathrm{abs}(\lambda_{i,i})\geq T_{reg}^{\Lambda},\\ 0 & \text{otherwise.}\end{cases}$$

The relative regularization scalar $T_{reg}^{\Lambda}$ is determined using absolute threshold $T_{reg}$ and maximal value of Λ as:

$$T_{reg}^{\Lambda}=\max_i(\lambda_{i,i})T_{reg},$$

with $T_{reg}=10^{-2}$, for example.

Depending on definition of the singular values, $\lambda_{i,i}$ can be restricted only to positive values (if $\lambda_{i,i}<0$ then $\lambda_{i,i}=\mathrm{abs}(\lambda_{i,i})$ and $\mathrm{sign}(\lambda_{i,i})$ is multiplied with the corresponding left or right singular vector) or negative values can be allowed.

In the second case with negative values of $\lambda_{i,i}$ the relative regularization scalar $T_{reg}^{\Lambda}$ is computed as:

$$T_{reg}^{\Lambda}=\max_i(\mathrm{abs}(\lambda_{i,i}))T_{reg}.$$

For simplicity, in the following the second definition of $T_{reg}^{\Lambda}$ will be used.

Similar results can be obtained using truncation of the singular values relative to an absolute value or other regularization methods used for matrix inversion.

Inversion of very small singular values may lead to very high un-mixing coefficients and consequently to high amplifications of the corresponding downmix channels. In such a case, channels with very small energy levels may be amplified using high gains and this may lead to audible artifacts. In order to reduce this undesired effect, the singular values smaller than the relative threshold $T_{reg}^{\Lambda}$ are truncated to zero.

Now, the discovered drawbacks in parametric object separation technique of the state of art are explained.

The described state of the art parametric object separation methods specify using regularized inversion of the downmix covariance matrix in order to avoid separation artifacts. However, for some real use case mixing scenarios, harmful artifacts caused by too aggressive regularization were identified in the output of the system.

In the following an example of such a scenario is constructed and analyzed.

A number N=5 of input audio objects (S) are encoded using the described technique (more precisely, the method of SAOC 3D processing part of MPEG-H 3D Audio) into a number $N_{dmx}=3$ of downmix channels (X).

The input audio objects of the example may consist of:

- one group of two correlated audio objects containing signals from musical accompaniment (Left and Right of a stereo pair),
- one group of one independent audio object containing a speech signal, and
- one group of two correlated audio objects containing a piano recording (Left and Right of a stereo pair).

The input signals are downmixed into three groups of transport channels:

- group $G_1$ with $M_1=1$ downmix channels, containing the first group of objects,
- group $G_2$ with $M_2=1$ downmix channels, containing the second group of objects, and
- group $G_3$ with $M_3=1$ downmix channels, containing the third group of objects, such that $N_{dmx}=M_1+M_2+M_3$.

The downmixing matrices $D_k$ corresponding to each group $G_k$, for k=1, 2, 3, are constructed using unitary mixing gains, and the complete downmixing matrix D is given by:

$$D=\begin{bmatrix}D_1 & 0 & 0\\ 0 & D_2 & 0\\ 0 & 0 & D_3\end{bmatrix}=\begin{bmatrix}1&1&0&0&0\\0&0&1&0&0\\0&0&0&1&1\end{bmatrix},$$

$$\text{with}\begin{cases}D_1=[1\ 1]\\ D_2=[1]\\ D_3=[1\ 1]\end{cases}$$

Figure 4:
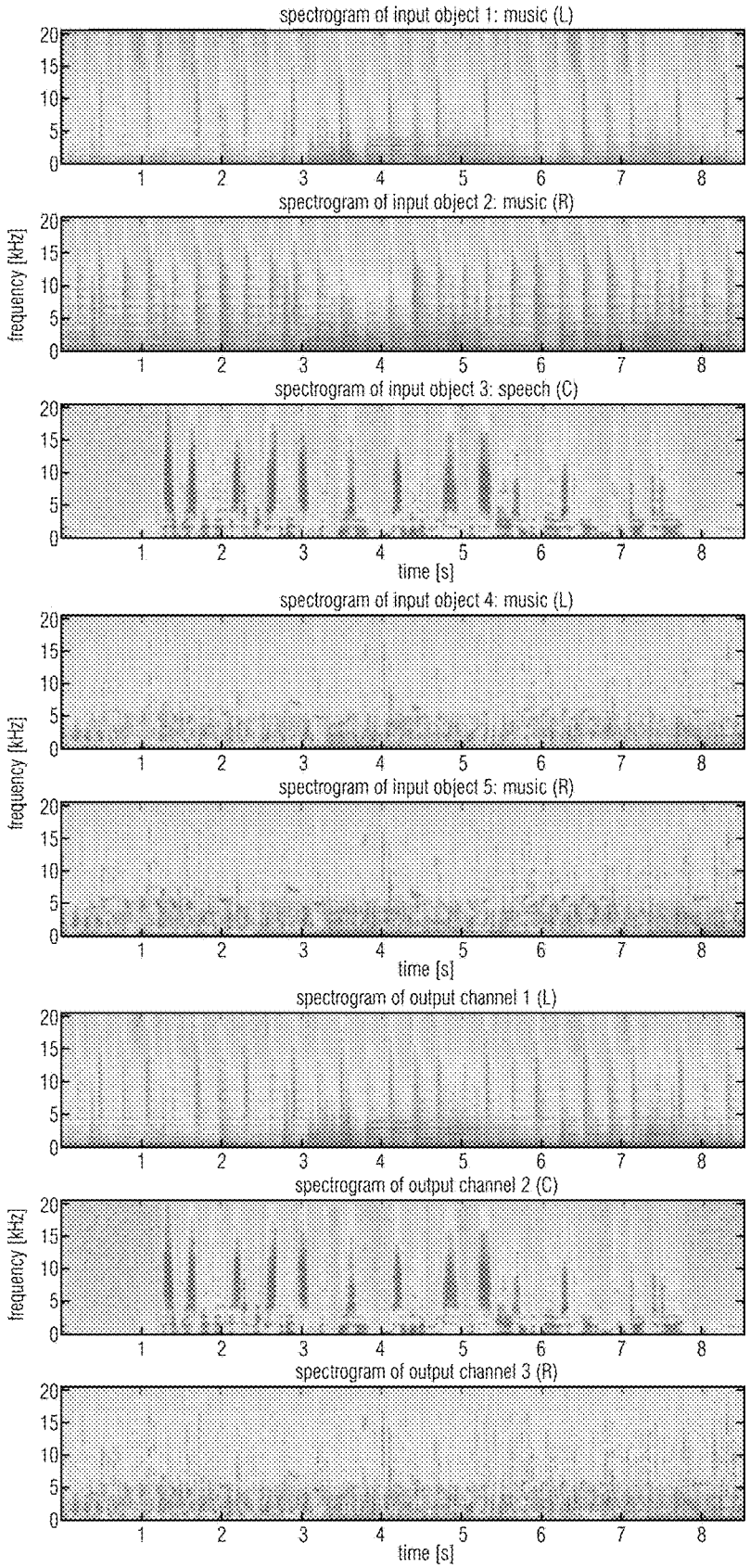
FIG. 4 shows spectrograms of five input audio objects (column on the left) and spectrograms of the corresponding downmix channels (column on the right)

One can note the absence of cross-mixing between the group of first two object signals, the third object signal, and the group of the last two object signals. Also note that the third object signal containing the speech is mixed alone into one downmix channel. Therefore, a good reconstruction of this object is expected and consequently also a good rendering. The spectrograms of the input signals and the obtained downmix signal are illustrated in FIG. 4.

The possible downmix signal core coding used in a real system is omitted here for better outlining of the undesired effect. At the decoder side the SAOC 3D parametric decoding is used to reconstruct and to render the audio object signals to a 3-channel setup ($N_{out}=3$): Left (L), Center (C), and Right (R) channels.

A simple remix of the input audio objects of the example is used in the following:

- the first two audio objects (the musical accompaniment) are muted (i.e., rendered with a gain 0),
- the third input object (the speech) is rendered to the center channel, and
- the object 4 is rendered to the left channel and the object 5 to the right channel.

Accordingly, the rendering matrix used is given by:

$$R=[R_1\ R_2\ R_3]=\begin{bmatrix}0&0&0&1&0\\0&0&1&0&0\\0&0&0&0&1\end{bmatrix}$$

$$\text{with: } R_1=\begin{bmatrix}0&0\\0&0\\0&0\end{bmatrix},\ R_2=\begin{bmatrix}0\\1\\0\end{bmatrix}\text{ and } R_3=\begin{bmatrix}1&0\\0&0\\0&1\end{bmatrix}.$$

The reference output can be computed by applying the specified rendering matrix directly to the input signals: $Y_{ref}=RS$.

Figure 5:
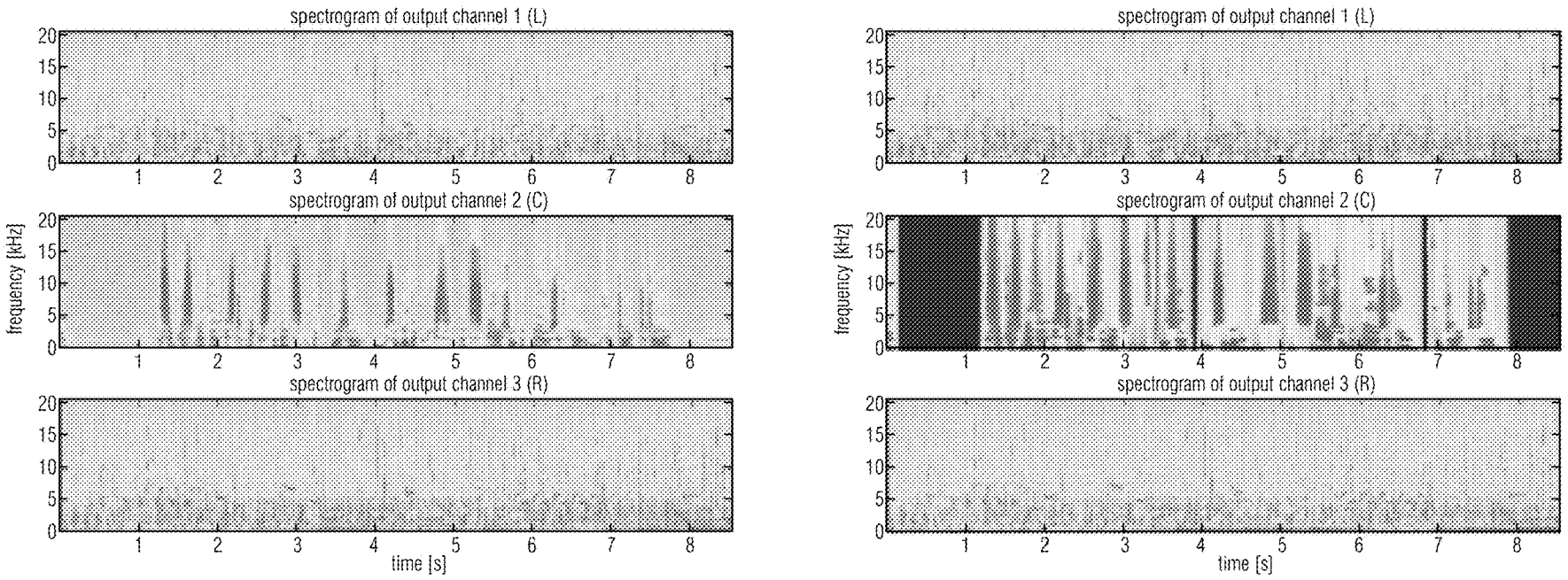
FIG. 5 shows spectrograms of reference output signals (column on the left) and spectrograms of the corresponding SAOC 3D decoded and rendered output signals (column on the right)

The spectrograms of the reference output and the output signals from SAOC 3D decoding and rendering are illustrated by the two columns of FIG. 5.

From the shown spectrograms of the SAOC 3D decoder output, the following observations can be noted:

- The center channel containing only the speech signal is severely damaged compared with the reference signal. Large spectral holes can be noticed. These spectral holes (being time-frequency regions with missing energy) lead into severe audible artifacts.
- Small spectral gaps are present also in the left and right channels, especially in the low frequency regions, where most of the signal energy is concentrated. Also these spectral gaps lead to audible artifacts.
- There is no cross-mixing of object groups in the downmix channels, i.e., the objects mixed in one downmix channel are not present in any other downmix channel. The second downmix channel contains only one object (the speech); therefore the spectral gaps in the system output can be generated only because it is processed together with the other downmix channels.

Based on the mentioned observations, it can be concluded that:

- The SAOC 3D system is not a "pass-through" system, i.e., if one input signal is mixed alone into one downmix channel, the audio quality of this input signal should be preserved in the decoding and rendering.
- The SAOC 3D system may introduce audible artifacts due to processing of multi-channel downmix signals. The output quality of objects contained in one group of downmix channels depends on the processing of the rest of the downmix channels.

The spectral gaps, especially the ones in the center channel, indicate that some useful information contained in the downmix channels is discarded by the processing. This loss of information can be traced back to parametric object separation step, more precisely to the downmix covariance matrix inversion regularization step.

By definition the downmixing matrix in the example has a block-diagonal structure:

$$D=\begin{bmatrix} D_1 & 0 & 0 \\ 0 & D_2 & 0 \\ 0 & 0 & D_3 \end{bmatrix}$$

Further, due to specified relation between input objects (e.g., signaling of parametric correlations) also the input object signal covariance matrix available in the decoder has a block-diagonal structure:

$$E=\begin{bmatrix} E_1 & 0 & 0 \\ 0 & E_2 & 0 \\ 0 & 0 & E_3 \end{bmatrix}$$

As a consequence, the downmix covariance matrix can be represented in a block-diagonal form:

$$E_{DMX}=\begin{bmatrix} E_1^{DMX} & 0 & 0 \\ 0 & E_2^{DMX} & 0 \\ 0 & 0 & E_3^{DMX} \end{bmatrix}=\begin{bmatrix} D_1E_1D_1^* & 0 & 0 \\ 0 & D_2E_2D_2^* & 0 \\ 0 & 0 & D_3E_3D_3^* \end{bmatrix}=DED^*$$

In this case, the matrix $E_{DMX}$ is already block-diagonal, but for the general case its block-diagonal form can be obtained after the permutation of rows/columns using the permutation operator $\Phi$: $E_{DMX}=\Phi E_{DMX}\Phi^*$.

A permutation operator $\Phi$ is defined as a matrix obtained by permutation of the rows of an identity matrix. If a symmetric matrix A can be represented in a block-diagonal form by permuting rows and columns, the permutation operator can be used to express the resulting matrix $\overline{A}$ as: $\overline{A}=\phi A\phi^*$.

If $\Phi$ is a permutation operator then the following properties hold:

- at first, if V is an unitary matrix then $T=\phi V$ is also an unitary matrix, and
- at second, $\phi\phi^*=\phi^*\phi=I$ with the identity matrix I.

As a consequence, the permutation operators are transparent to singular value decomposition algorithms. This means that the original matrix A and the permuted matrix $\overline{A}$ share the same singular values and permuted singular vectors:

$$V\Lambda V^*=A\Rightarrow\begin{cases}(\Phi V)\Lambda(\Phi V)^*=\Phi A\Phi^* \\ (\Phi V)\Lambda(\Phi V)^*=\overline{A}\end{cases}\Rightarrow T\Lambda T^*=\overline{A},\text{ with }T=\Phi V$$

Due to the block-diagonal representation, the singular values of matrix $E_{DMX}$ can be computed by applying the SVD to matrix $E_{DMX}$ or by applying the SVD to the block-diagonal sub-matrices $E^{DMX}_k$ and combining the results:

$$E_{DMX}=V\Lambda V^*=\begin{bmatrix} V_1\Lambda_1V_1^* & 0 & 0 \\ 0 & V_2\Lambda_2V_2^* & 0 \\ 0 & 0 & V_3\Lambda_3V_3^* \end{bmatrix}$$

$$\text{with }\Lambda=\begin{bmatrix} \lambda_{1,1} & 0 & 0 \\ 0 & \lambda_{2,2} & 0 \\ 0 & 0 & \lambda_{3,3} \end{bmatrix},$$

$$\Lambda_1=[\lambda_{1,1}],$$

$$\Lambda_2=[\lambda_{2,2}]\text{ and}$$

$$\Lambda_3=[\lambda_{3,3}].$$

Since the singular values of the downmix covariance matrix are directly related to the energy levels of the downmix channels (which are described by the main diagonal of matrix $E_{DMX}$):

$$\sum_{k=1}^{N_{dmx}}\lambda_{k,k}=\sum_{k=1}^{N_{dmx}}E_{DMX}(k,k)$$

and objects contained in one channel are not contained in any other downmix channel, one can conclude that each singular value corresponds to one downmix channel.

Therefore, if one of the downmix channels has much smaller energy level than the rest of the downmix channels, the singular value corresponding to this channel will be much smaller than the rest of the singular values.

The truncation step used in the inversion of the matrix containing the singular values of matrix $E_{DMX}$:

$$\Lambda^{inv} = \lambda_{i,j}^{-1} = \begin{cases} \frac{1}{\lambda_{i,i}} & i = j \text{ and } \lambda_{i,i} \geq T_{reg}^{\Lambda}, \\ 0 & \text{otherwise,} \end{cases}$$

or $$\Lambda^{inv} = \lambda_{i,j}^{-1} = \begin{cases} \frac{1}{\lambda_{i,i}} & i = j \text{ and abs}(\lambda_{i,i}) \geq T_{reg}^{\Lambda}, \\ 0 & \text{otherwise,} \end{cases}$$

can lead to truncation of singular values corresponding to the downmix channel with the small energy level (with respect to the downmix channel with the highest energy). Because of this, the information present in this downmix channel with small relative energy is discarded and the spectral gaps observed in the spectrogram figures and audio output are generated.

For a better understanding, it has to be taken into account that the downmixing of the input audio objects happens for each sample and for each frequency band separately. Especially the separation into different bands helps to understand why gaps can be found in the spectrograms of the output signals at different frequencies.

The identified problem can be isolated down to the fact that the relative regularization threshold is computed for singular values without considering that the matrix to be inverted is block-diagonal:

$$T_{reg}^{\Lambda} = \max_i(\text{abs}(\lambda_{i,i}))T_{reg}.$$

Each block-diagonal matrix corresponds to one independent group of downmix channels. The truncation is realized relative to the largest singular value, but this value describes only one group of channels. Thus, the reconstruction of objects contained in all independent groups of downmix channels becomes dependent on the group which contains this largest singular value.

In the following the invention will be explained based on the embodiment discussed above concerning the state of art:

Considering the example described above, the three covariance matrices can be associated to three different groups of downmix channels $G_k$ with $1 \leq k \leq 3$. The audio objects or input audio objects contained in the downmix channels of each group are not contained in any other group. Additionally, no relation (e.g., correlation) is signaled between objects contained in downmix channels from different groups.

In order to solve the identified problem of the parametric reconstruction system, the inventive method proposes to apply the regularization step independently for each group. This implies that three different thresholds are computed for the inversion of the three independent downmix covariance matrices:

$$T_{reg}^{\Lambda} = \max_i(\text{abs}(\lambda_{i,i}))T_{reg},$$

where $1 \leq k \leq 3$. Hence, in the invention in one embodiment such a threshold is computed for each group separately and not as in the state of art one overall threshold for the respective frequency bands and samples.

The inversion of the singular values is obtained accordingly by applying the regularization independently for the sub-matrices $E^{DMX}{}_k$, with $1 \leq k \leq 3$:

$$\Lambda_k^{inv} = (\lambda_{i,j}^{-1})_{i,j \in G_k} = \begin{cases} \frac{1}{\lambda_{i,i}} & i = j \text{ and } \lambda_{i,i} \geq T_{reg}^{\Lambda,G_k}, \\ 0 & \text{otherwise.} \end{cases}$$

In a different embodiment, the following formula is used:

$$\Lambda_k^{inv} = (\lambda_{i,j}^{-1})_{i,j \in G_k} = \begin{cases} \frac{1}{\lambda_{i,i}} & i = j \text{ and abs}(\lambda_{i,i}) \geq T_{reg}^{\Lambda,G_k}, \\ 0 & \text{otherwise.} \end{cases}$$

Using the proposed inventive method in an otherwise identical SAOC 3D system for the example discussed in the previous section, the audio output quality of the decoded and rendered output improves. The resulting signals are illustrated in FIG. 6.

Figure 6:
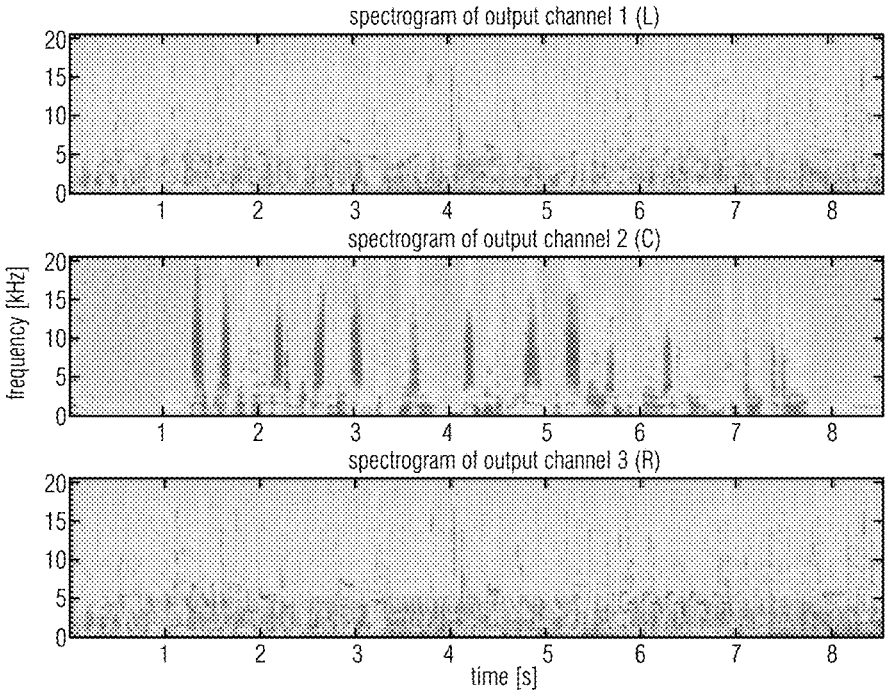
FIG. 6 shows spectrograms of the SAOC 3D output signals using the invention.

Comparing the spectrograms in the right column of FIG. 5 and of FIG. 6, it can be observed that the inventive method solves the identified problems in the existing known parametric separation system. The inventive method ensures the "pass-through" feature of the system, and most importantly, the spectral gaps are removed.

The described solution for processing three independent groups of downmix channels can be easily generalized to any number of groups.

The inventive method proposes to modify the parametric object separation technique by making use of grouping information in the inversion of the downmix signal covariance matrix. This leads into significant improvement of the audio output quality.

The grouping can be obtained, e.g., from mixing and/or correlation information already available in the decoder without additional signaling.

More precisely one group is defined in one embodiment by the smallest set of downmix signals with the following two properties in this example:

Firstly, the input audio objects contained in these downmix channels are not contained in any other downmix channel.

Secondly, all input signals contained in the downmix channels of one group are not related (e.g., no intercorrelation is signaled within the encoded audio signal) to any other input signals contained in downmix channels of any other group. Such an intercorrelation implies a combined handling of the respective audio objects during the decoding.

Based on the introduced group definition, a number of K ($1 \leq K \leq N_{dmx}$) groups can be defined: $G_k$ ($1 \leq k \leq K$) and the downmix covariance matrix $E_{DMX}$ can be expressed using a block-diagonal form by applying a permutation operator $\Phi$:

$$\overline{E}_{DMX} = \Phi E_{DMX} \Phi^* = \begin{bmatrix} E_1^{DMX} & 0 & \dots & 0 \\ 0 & E_2^{DMX} & \dots & 0 \\ \vdots & \vdots & \ddots & \vdots \\ 0 & 0 & \dots & E_K^{DMX} \end{bmatrix}$$

The sub-matrices $E^{DMX}{}_k$ are constructed by selecting elements of the downmix covariance matrix corresponding to the independent groups $G_k$. For each group $G_k$, the matrix $E^{DMX}{}_k$ of size $M_k$ times $M_k$ is expressed using SVD as: $E^{DMX}{}_k = V_k \Lambda_k V_k^*$ with:

$$\Lambda_k = \begin{bmatrix} \lambda_{1,1}^k & 0 & \dots & 0 \\ 0 & \lambda_{2,2}^k & \dots & 0 \\ \vdots & \vdots & \ddots & \vdots \\ 0 & 0 & \dots & \lambda_{M_k,M_k}^k \end{bmatrix} \text{ and } \sum_{k=1}^{K} M_k = N_{dmx}.$$

The pseudo-inverse of matrix $E^{DMX}{}_k$ is computed as $(E^{DMX}{}_k)^{-1} = V_k \Lambda^{inv}{}_k V_k^*$ where the regularized inverse matrix $\Lambda^{inv}{}_k$ is given in one embodiment by:

$$\Lambda_k^{inv} = (\lambda_{i,j}^{-1})_{i,j \in G_k} = \begin{cases} \frac{1}{\lambda_{i,i}} & i = j \text{ and } \lambda_{i,i} \geq T_{reg}^{\Lambda_k}, \\ 0 & \text{otherwise.} \end{cases}$$

and in a different embodiment by:

$$\Lambda_k^{inv} = (\lambda_{i,j}^{-1})_{i,j \in G_k} = \begin{cases} \frac{1}{\lambda_{i,i}} & i = j \text{ and abs}(\lambda_{i,i}) \geq T_{reg}^{\Lambda_k}, \\ 0 & \text{otherwise.} \end{cases}$$

The relative regularization scalar $T_{reg}{}^{\Lambda_k}$ is determined using absolute threshold $T_{reg}$ and maximal value of $\Lambda_k$ as:

$$T_{reg}^{\lambda_k} = \max_{i \in G_k}(\lambda_{i,i}) T_{reg}$$

with $T_{reg} = 10^{-2}$ for example.

The inverse of the permuted downmix covariance matrix $\overline{E}_{DMX}$ is obtained as:

$$\overline{E}_{DMX}^{-1} = \begin{bmatrix} (E_1^{DMX})^{-1} & 0 & \dots & 0 \\ 0 & (E_2^{DMX})^{-1} & \dots & 0 \\ \vdots & \vdots & \ddots & \vdots \\ 0 & 0 & \dots & (E_K^{DMX})^{-1} \end{bmatrix}$$

and the inverse of the downmix covariance matrix is computed by applying the inverse permutation operation: $E_{DMX}{}^{-1} = \Phi^* \overline{E}_{DMX}{}^{-1} \Phi$.

Additionally, the inventive method proposes in one embodiment to determine the groups based entirely on information contained in the bitstream. For example, this information can be given by downmixing information and correlation information.

More precisely, one group $G_k$ is defined by the smallest set of downmix channels with the following properties:

- The input audio objects contained in the downmix channels of group $G_k$ are not contained in any other downmix channel. An input audio object is not contained in a downmix channel, for example, if the corresponding downmix gain is given by the smallest quantization index, or if it is equal to zero.
- All input signals i contained in the downmix channels of group $G_k$ are not related to any input signal j contained in any downmix channel of any other group. For example (compare e. g. WO 2011/039195 A1) the bitstream variable bsRelatedTo[i][j] can be used to signal if two objects are related (bsRelatedTo[i][j]==1) or if they are not related (bsRelatedTo[i][j]==0). Also different methods of signaling two objects being related can be used based on correlation or covariance information, for example.

The groups can be determined once per frame or once per parameter set for all processing bands, or once per frame or once per parameter set for each processing band.

The inventive method also allows in one embodiment to reduce significantly the computational complexity of the parametric separation system (e.g., SAOC 3D decoder) by making use of the grouping information in the most computational expensive parametric processing components.

Therefore, the inventive method proposes to remove computations which do not bring any contribution to final output audio quality. These computations can be selected based on the grouping information.

More precisely, the inventive method proposes to compute all the parametric processing steps independently for each pre-determined group and to combine the results in the end.

Using the example of SAOC 3D processing part of MPEG-H 3D Audio the computationally complex operations are given by:

- computation of covariance matrix E of size N times N with the elements: $e_{i,j} = \sqrt{OLD_i OLD_j} IOC_{i,j}$,
- computation of downmix signal covariance matrix Δ of size $N_{dmx}$ times $N_{dmx}$: $\Delta = DED^*$,
- computation of singular value decomposition of matrix $\Delta = DED^*$: $\Delta = V\Lambda V^*$,
- computation of the regularized inverse matrix J approximating $J \approx \Delta^{-1}$: $J = V\Lambda^{inv}V^*$,
- computation of the parametric un-mixing matrix U of size N times $N_{dmx}$: $U = ED^*J$,
- multiplication of the rendering matrix R of size $N_{out}$ times N with the un-mixing matrix U of size N times $N_{dmx}$: RU,
- computation of the covariance matrix C of size $N_{out}$ times $N_{out}$: $C = RER^*$,
- computation of the covariance of the parametrically estimated signal $E_y{}^{dry}$ of size $N_{out}$ times $N_{out}$: $E_Y{}^{dry} = RU(DED^*)U^*R^*$.

The Object Level Differences (OLD) refers to the relative energy of one object to the object with most energy for a certain time and frequency band and Inter-Object Cross Coherence (IOC) describes the amount of similarity, or cross-correlation for two objects in a certain time and frequency band.

The inventive method is proposing to reduce the computational complexity by computing all the parametric processing steps for all pre-determined K groups $G_k$ with $1 \leq k \leq K$ independently, and combining the results in the end of the parameter processing.

One group $G_k$ contains $M_k$ downmix channels and $N_k$ input audio objects such that:

$$\sum_{k=1}^{K} M_k = N_{dmx} \text{ and } \sum_{k=1}^{K} N_k = N.$$

For each group $G_k$, a group downmixing matrix is defined as $D_k$ by selecting elements of downmixing matrix D corresponding to downmix channels and input audio objects contained by group $G_k$.

Similarly a group rendering matrix $R_k$ is obtained out of the rendering matrix R by selecting the rows corresponding to input audio objects contained by group $G_k$.

Similarly a group vector $OLD^k$ and a group matrix $IOC^k$ are obtained out of the vector OLD and the matrix IOC by selecting the elements corresponding to input audio objects contained by group $G_k$.

For each group $G_k$, the described processing steps are replaced with less computationally processing steps as following:

- computation of group covariance matrix $E_k$ of size $N_k$ times $N_k$ with the elements: $e_{i,j}^k=\sqrt{OLD_i^k OLD_j^k}IOC_{i,j}^k$,
- computation of group downmix covariance matrix $\Delta_k$ of size $M_k$ times $M_k$: $\Delta_k=D_kE_kD_k^*$,
- computation of singular value decomposition of group downmix covariance matrix $\Delta_k=D_kE_kD_k^*$: $\Delta_k=V_k\ \Lambda_k\ V_k^*$,
- computation of the regularized inverse group matrix $J_k$ approximating $J_k\approx\Delta_k^{-1}$: $J_k=V_k\Lambda_k^{inv}V^*_k$,
- computation of the group parametric un-mixing matrix $U_k$ of size $N_k$ times $M_k$: $U_k=E_kD_k^*J_k$,
- multiplication of the group rendering matrix $R_k$ of size $N_{Upmix}$ times $N_k$ with the unmixing matrix $U_k$ of size $N_k$ times $M_k$: $R_kU_k$,
- computation of the group covariance matrix $C_k$ of size $N_{out}$ times $N_{out}$: $C_k=R_kE_kR_k^*$,
- computation of the group covariance of the parametrically estimated signal $(E_y^{dry})_k$ of size $N_{out}$ times $N_{out}$: $(E_Y^{dry})_k=R_kU_k\ (D_kE_kD^*_k)U^*_kR^*_k$.

And the results of individual group processing steps are combined in the end:

- the upmixing matrix RU of size $N_{out}$ times $N_{dmx}$ is obtained by merging the group matrices $R_kU_k$: $RU=[R_1U_1\ R_2U_2\ \ldots\ R_KU_K]$,
- the covariance matrix C of size $N_{out}$ times $N_{out}$ is obtained by summing up the group matrices $C_k$:

$$C=\sum_{k=1}^{K}C_k,$$

- the covariance of the parametrically estimated signal $E_y^{dry}$ of size $N_{out}$ times $N_{out}$ is obtained by summing up the group matrices $(E_y^{dry})_k$:

$$E_Y^{dry}=\sum_{k=1}^{K}(E_Y^{dry})_k$$

Figure 7:
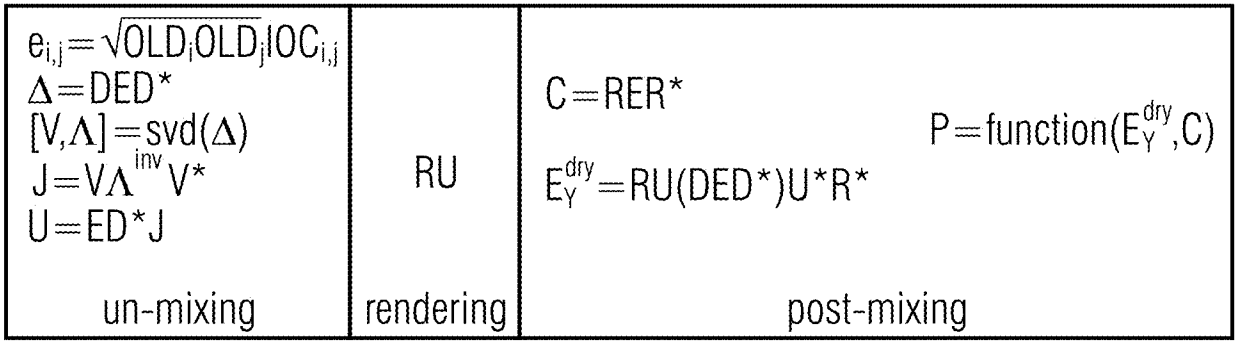
FIG. 7 shows a frame parameter processing according to the state of art.

Summarizing the processing steps according to the structure of the downmix processor illustrated in FIG. 3, while omitting the decorrelation step, the existing known frame parameter processing can be depicted as in FIG. 7.

Figure 8:
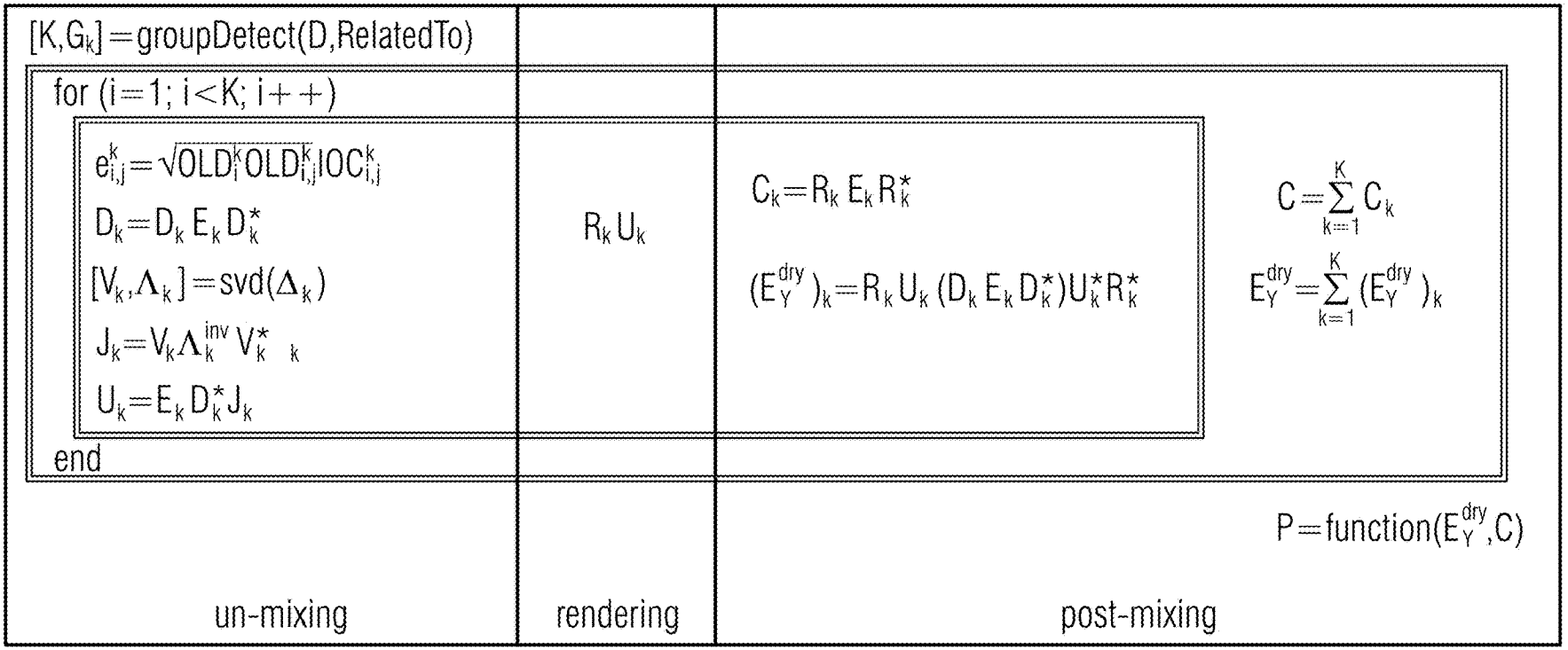
FIG. 8 shows a frame parameter processing according to the invention, FIG. 9A, FIG. 9B

Using the proposed inventive method the computation complexity is reduced using the group detection as illustrated in FIG. 8.

An example of an implementation of a group detection function, called: $[K,G_k]$=groupDetect(D,RelatedTo), is given in FIG. 9A, FIG. 9B and FIG. 9C using ANSI C code and the static function "getSaocCoreGroups( )".

The proposed inventive method proves to be significantly computationally much more efficient than performing the operations without grouping. It also allows better memory allocation and usage, supports computation parallelization, reduces numerical error accumulation, etc.

The proposed inventive method and the proposed inventive apparatus solve an existing problem of the state of the art parametric object separation systems and offer significantly higher output audio quality.

Proposed inventive method describes a group detection method which is entirely realized based on the existing bitstream information.

The proposed inventive grouping solution leads to a significant reduction in computational complexity. In general, the singular value decomposition is computationally expensive and its complexity grows exponentially with the size of the matrix to be inverted: $O(N_{dmx}^3)$.

For large number of downmix channels, computing K times an SVD operation for smaller sized matrix is computationally much more efficient:

$$\sum_{k=1}^{K}O(M_k^3).$$

Using the same considerations, all the parametric processing steps in the decoder can be efficiently implemented by computing all the matrix multiplications described in the system only for the independent groups and combining the results.

An estimation of the complexity reduction for different number of input audio objects, i.e. input audio objects, downmix channels, and a fixed number of 24 output channels is given in the following table:

| | | | | | | | |
|---|---|---|---|---|---|---|---|
| Number of input audio objects | 8 | 16 | 32 | 60 | 96 | 128 | 256 |
| Number of downmix channels, $N_{dmx}$ | 4 | 8 | 16 | 24 | 24 | 32 | 64 |
| Number of groups, K | 2 | 4 | 4 | 6 | 6 | 8 | 8 |
| SAOC 3D parameter processing [MOPS] | 7.5 | 28 | 56 | 464 | 1000 | 2022 | 12000 |
| Inventive method parameter processing [MOPS] | 3 | 3 | 7.5 | 10 | 20 | 20 | 81 |
| Complexity reduction [%] | 60.00 | 89.29 | 86.61 | 97.84 | 98.00 | 99.01 | 99.33 |

The invention presents the following additional advantages:

- For situations when only one group can be created, the output is bit-identical with the current state of the art system.
- Grouping preserves the "pass-through" feature of the system. This implies that if one input audio object is mixed alone into one downmix channel, the decoder is capable of reconstructing it perfectly.

The invention leads to the following proposed exemplary modifications for the standard text.

Add in "9.5.4.2.4 Regularized inverse operation":

The regularized inverse matrix J approximating $J \approx \Delta^{-1}$ is calculated as $J = V\Lambda^{inv}V^*$.

The matrices V and Λ are determined as the singular value decomposition of the matrix Δ as: $\Delta = V\Lambda V^*$.

The regularized inverse $\Lambda^{inv}$ of the diagonal singular value matrix Λ is computed according to 9.5.4.2.5.

In the case the matrix Δ is used in the calculation of the parametric un-mixing matrix U, the operations described are applied for all sub-matrices $\Delta_k$. A sub-matrix $\Delta_k$ is obtained by selecting the elements Δ (m, n) corresponding to the downmix channels m and n assigned to the group k.

The group k is defined by the smallest set of downmix channels with the following properties:

- The input signals contained in the downmix channels of group k are not contained in any other downmix channel. An input signal is not contained in a downmix channel if the corresponding downmix gain is given by the smallest quantization index (Table 49 of ISO/IEC 23003-2:2010).
- All input signals i contained in the downmix channels of group k are not related to any input signal contained in any downmix channel of any other group (i.e., bsRelatedTo[i][j]==0).

The results of the independent regularized inversion operations $J_k \approx \Delta_k^{-1}$ are combined for obtaining the matrix J.

The invention also leads to the following proposed exemplary modifications for the standard text.

9.5.4.2.5 Regularized Inverse Operation

The regularized inverse matrix J approximating $J \approx \Delta^{-1}$ is calculated as:

$$J = V\Lambda^{inv}V^*.$$

The matrices V and Λ are determined as the singular value decomposition of the matrix Δ as:

$$V\Lambda V^* = \Delta.$$

The regularized inverse $\Lambda^{inv}$ of the diagonal singular value matrix Λ is computed according to 9.5.4.2.6.

In the case the matrix Δ is used in the calculation of the parametric un-mixing matrix U, the operations described are applied for all sub-matrices $\Delta_q$. A sub-matrix $\Delta_q$ of size $N_g^q \times N_g^q$, with elements $\Delta_q(idx_1, idx_2)$, is obtained by selecting the elements $\Delta(ch_1, ch_2)$ corresponding to the downmix channels $ch_1$ and $ch_2$ assigned to the group $g_q$ (i.e., $g_q(idx_1) = ch_1$ and $g_q(idx_2) = ch_2$).

The group $g_q$ of size $1 \times N_g^q$ is defined by the smallest set of downmix channels with the following properties:

- The input signals contained in the downmix channels of group $g_q$ are not contained in any other downmix channel. An input signal is not contained in a downmix channel if the corresponding downmix gain is given by the smallest quantization index (Table 49 of ISO/IEC 23003-2:2010).
- All input signals i contained in the downmix channels of group $g_q$ are not related to any input signal j contained in any downmix channel of any other group (i.e., bsRelatedTo[i][j]==0).

The results of the independent regularized inversion operations $J_q = \Delta_q^{-1}$ are combined for obtaining the matrix J as:

$$J(ch_1, ch_2) = \begin{cases} J_q(idx_1, idx_2), & \text{if } g_q(idx_1) = ch_1 \text{ and } g_q(idx_2) = ch_2, \\ 0, & \text{otherwise.} \end{cases}$$

9.5.4.2.6 Regularization of Singular Values

The regularized inverse operation $(\bullet)^{inv}$ used for the diagonal singular value matrix Λ is determined as:

$$\Lambda^{inv} = \lambda_{i,j}^{-1} = \begin{cases} \frac{1}{\lambda_{i,i}} & \text{if } i = j \text{ and } \mathrm{abs}(\lambda_{i,i}) \geq T_{reg}^{\Lambda}, \\ 0, & \text{otherwise.} \end{cases}$$

The relative regularization scalar $T_{reg}^{\Lambda}$ is determined using absolute threshold $T_{reg}$ and maximal value of Λ as follows:

$$T_{reg}^{\Lambda} = \max_i(\mathrm{abs}(\lambda_{i,i}))T_{reg}, \text{ with } T_{reg} = 10^{-2}.$$

In some of the following figures individual signals are shown as being obtained from different processing steps. This is done for a better understanding of the invention and is one possibility to realize the invention, i.e., extracting individual signals and performing processing steps on these signals or processed signals.

The other embodiment is calculating all significant matrices and applying them as a last step to the encoded audio signal in order to obtain the decoded audio signal. This includes the calculation of the different matrices and their respective combinations.

An embodiment combines both ways.

Figure 10:
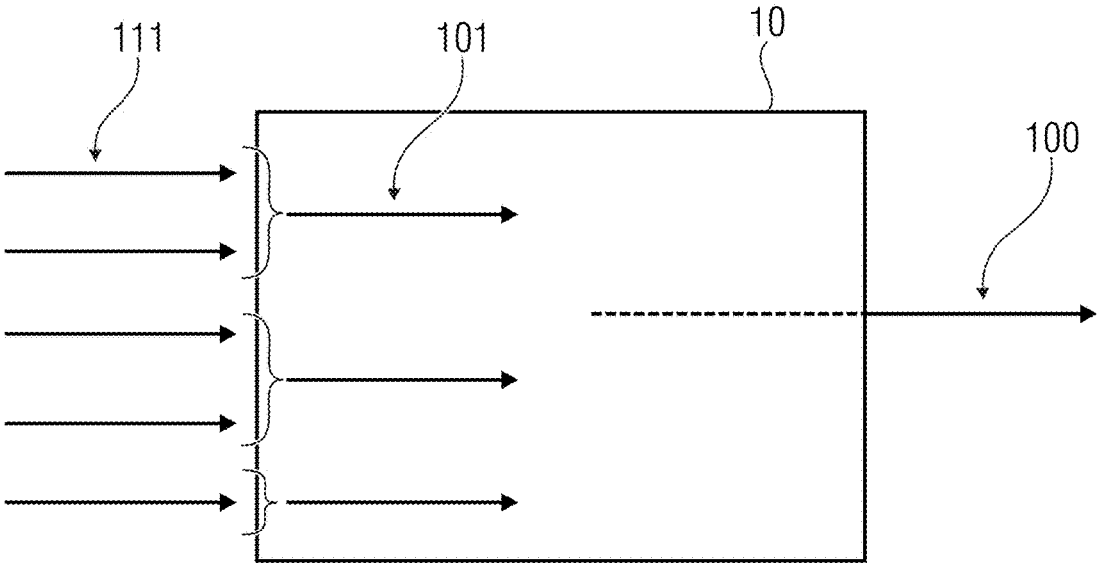
FIG. 10 shows schematically an apparatus for encoding input audio objects.

FIG. 10 shows schematically an apparatus 10 for processing a plurality (here in this example five) of input audio objects 111 in order to provide a representation of the input audio objects 111 by an encoded audio signal 100.

The input audio objects 111 are allocated or down-mixed into downmix signals 101. In the shown embodiment four of the five input audio objects 111 are assigned to two downmix signals 101. One input audio object 111 alone is assigned to a third downmix signal 101. Thus, five input audio objects 111 are represented by three downmix signals 101.

These downmix signals 101 afterwards—possibly following some not shown processing steps—are combined to the encoded audio signal 100.

Figure 11:
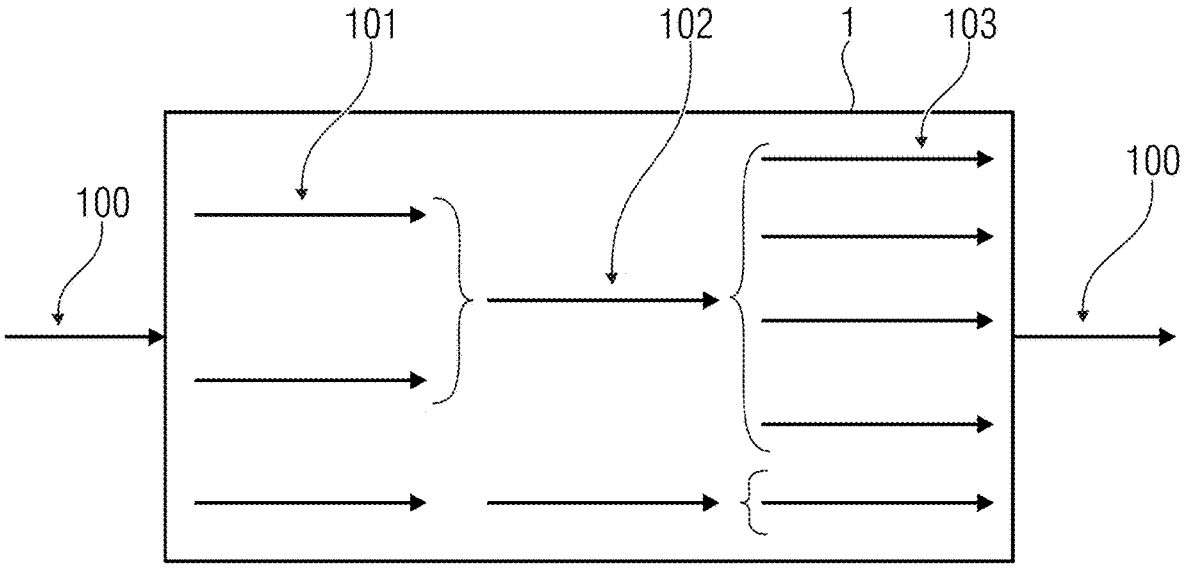
FIG. 11 shows schematically an example of an inventive apparatus for processing an encoded audio signal.

Such an encoded audio signal 100 is fed to an inventive apparatus 1, for which one embodiment is shown in FIG. 11.

From the encoded audio signal 100 the three downmix signals 101 (compare FIG. 10) are extracted.

The downmix signals 101 are grouped—in the shown example—into two groups of downmix signals 102.

As each downmix signal 101 is associated with a given number of input audio objects, each group of downmix signals 102 refers to a given number of input audio objects (a corresponding expression is input object). Hence, each group of downmix signals 102 is associated with a set of input audio objects of the plurality of input audio objects which are encoded by the encoded audio signal 100 (compare FIG. 10).

The grouping happens in the shown embodiment under the following constrictions:

1. Each input audio object 111 belongs to just one set of input audio objects and, thus, to one group of downmix signals 102.
2. Each input audio object 111 has no relation signaled in the encoded audio signal to an input audio object 111 belonging to a different set associated with a different group of downmix signals. This means that the encoded audio signal has no such information which due to the standard would result in a combined computation of the respective input audio objects.

3. The number of downmix signals 101 within the respective groups 102 is minimized.

The (here: two) groups of downmix signals 102 are processed individually in the following to obtain five output audio signals 103 corresponding to the five input audio objects 111.

One group of downmix signals 102 which is associated with the two downmix signals 101 covering two pairs of input audio objects 111 (compare FIG. 10) allows to obtain four output audio signals 103.

The other group of downmix signals 102 leads to one output signal 103 as the single downmix signal 101 or this group of downmix signals 102 (or more precisely: group of one signal downmix signal) refers to one input audio object 111 (compare FIG. 10).

The five output audio signals 103 are combined into one decoded audio signal 110 as output of the apparatus 1.

In the embodiment of FIG. 11 all processing steps are performed individually on the groups of downmix signals 102.

Figure 12:
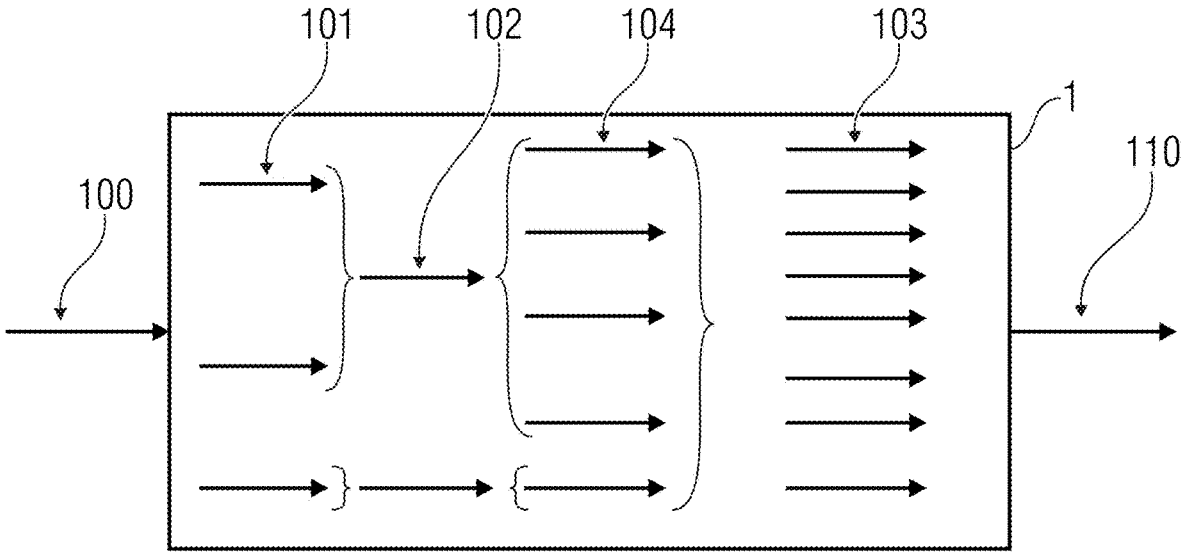
FIG. 12 shows schematically a different example of an inventive apparatus for processing an encoded audio signal.

The embodiment of the apparatus 1 shown in FIG. 12 may receive here the same encoded audio signal 100 as the apparatus 1 shown in FIG. 11 and obtained by an apparatus 10 as shown in FIG. 10.

From the encoded audio signal 100 the three downmix signals 101 (for three transport channels) are obtained and grouped into two groups of downmix signals 102. These groups 102 are individually processed to obtain five processed signals 104 corresponding to the five input audio objects shown in FIG. 10.

In the following steps, from the five processed signals 104 jointly eight output audio signals 103 are obtained, e.g., rendered to be used for eight output channels. The output audio signals 103 are combined into the decoded audio signal 110 which is output from the apparatus 1. In this embodiment, an individual as well as a joint processing is performed on the groups of the downmix signals 102.

Figure 13:
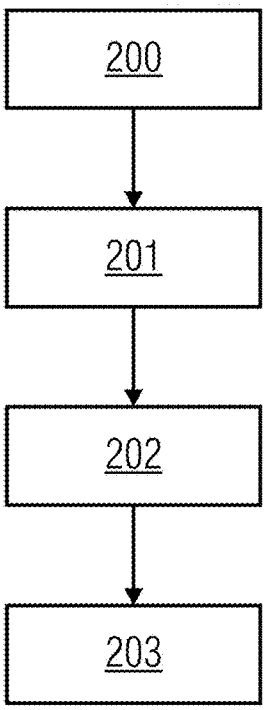
FIG. 13 shows a sequence of steps of an embodiment of the inventive method.

FIG. 13 shows some steps of an embodiment of the inventive method in which an encoded audio signal is decoded.

In step 200 the downmix signals are extracted from the encoded audio signal. In the following step 201, the downmix signals are allocated to groups of downmix signals.

In step 202 each group of downmix signals is processed individually in order to provide individual group results. The individual handling of the groups comprises at least the unmixing for obtaining representations of the audio signals which were combined via the downmixing of the input audio objects in the encoding process. In one embodiment—not shown here—the individual processing is followed by a joint processing.

In step 203 these group results are combined into a decoded audio signal to be output.

FIG. 14 once again shows an embodiment of the apparatus 1 in which all processing steps following the grouping of the downmix signals 101 of the encoded audio signal 100 into groups of downmix signals 102 are performed individually. The apparatus 1 which receives the encoded audio signal 100 with the downmix signals 101 comprises a grouper 2 which groups the downmix signals 101 in order to provide the groups of downmix signals 102. The groups of downmix signals 102 are processed by a processor 3 performing all mandatory steps individually on each group of downmix signals 102. The individual group results of the processing of the groups of downmix signals 102 are output audio signals 103 which are combined by the combiner 4 in order to obtain the decoded audio signal 110 to be output by the apparatus 1.

Figure 14:
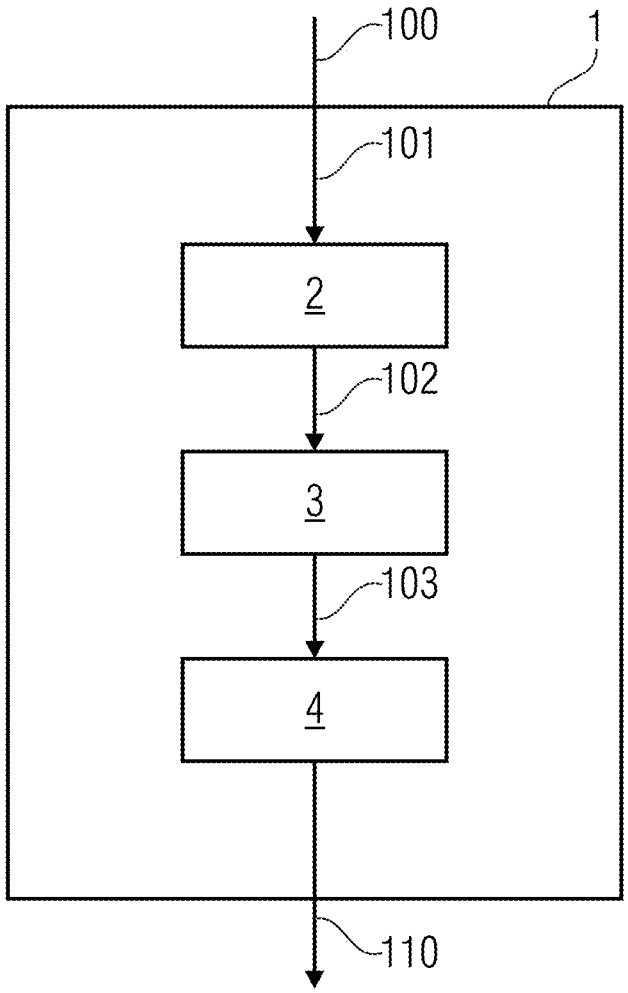
FIG. 14 shows schematically an example of an inventive apparatus.
Figure 15:
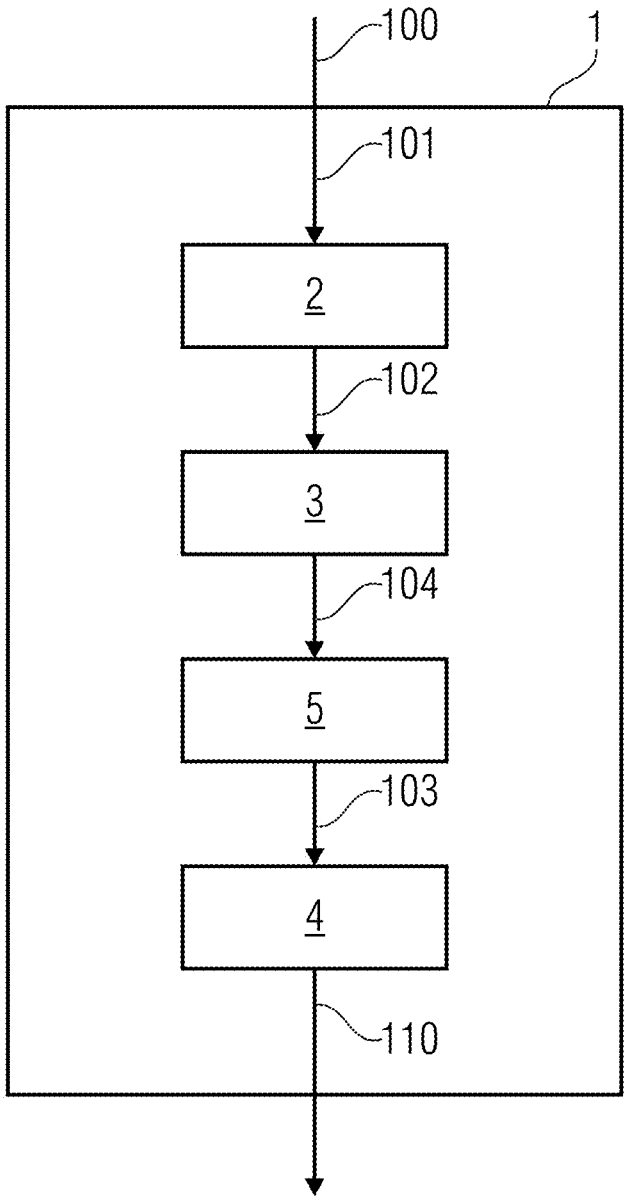
FIG. 15 shows schematically a further example of an apparatus.

The apparatus 1 shown in FIG. 15 differs from the embodiment shown in FIG. 14 following the grouping of the downmix signals 101. In the example, not all processing steps are performed individually on the groups of downmix signals 102 but some steps are performed jointly, thus taking more than one group of downmix signals 102 into account.

Due to this, the processor 3 in this embodiment is configured to perform just some or at least one processing step individually. The result of the processing are processed signals 104 which are processed jointly by the post-processor 5. The obtained output audio signals 103 are finally combined by the combiner 4 leading to the decoded audio signal 110.

Figure 16:
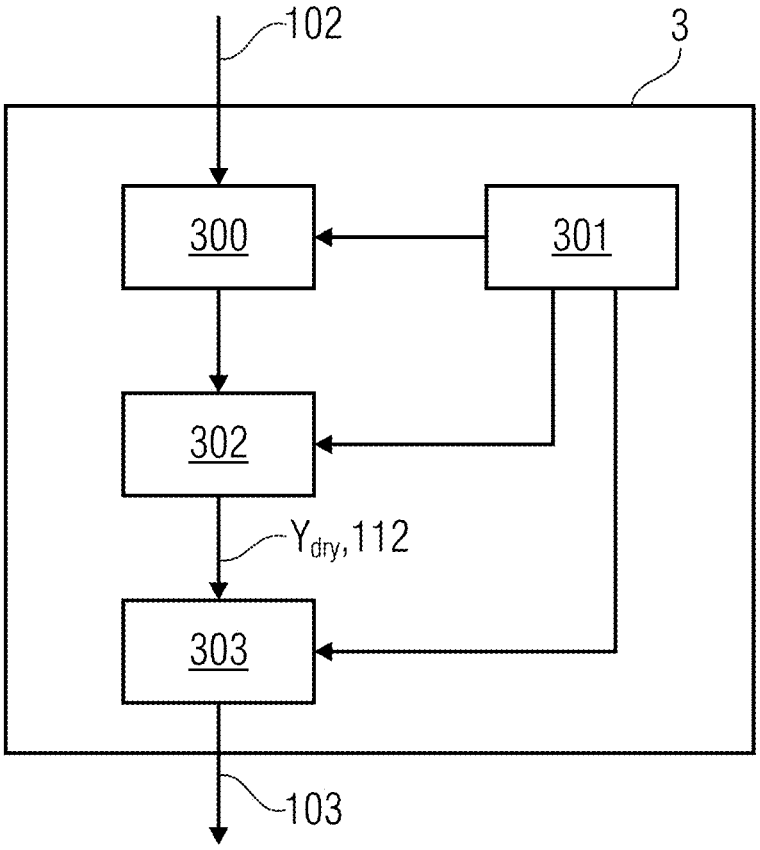
FIG. 16 shows schematically a processor of an inventive apparatus.

In FIG. 16 a processor 3 is schematically shown receiving the groups of downmix signals 102 and providing the output audio signals 103.

The processor 3 comprises an un-mixer 300 configured to un-mix the downmix signals 101 of the respective groups of downmix signals 102. The un-mixer 300, thus, reconstructs the individual input audio objects which were combined by the encoder into the respective downmix signals 101.

The reconstructed or separated input audio objects are submitted to a renderer 302. The renderer 302 is configured to render the un-mixed downmix signals of the respective groups for an output situation of said decoded audio signal 110 in order to provide rendered signals 112. The rendered signals 112, thus, are adapted to the kind of replay scenario of the decoded audio signal. The rending depends, e.g., on the number of loudspeakers to be used, to their arrangement or to the kind of effects to be obtained by the playing of the decoded audio signal.

The rendered signals 112, $Y_{dry}$, further, are submitted to a post-mixer 303 configured to perform at least one decorrelation step on said rendered signals 112 and configured to combine results $Y_{wet}$ of the performed decorrelation step with said respective rendered signals 112, $Y_{dry}$. The post-mixer 303, thus, performs steps to decorrelate the signals which were combined in one downmix signal.

The resulting output audio signals 103 are finally submitted to a combiner as shown above.

For the steps, the processor 3 relies on a calculator 301 which is here separate from the different units of the processor 3 but which is in an alternative—not shown—embodiment a feature of grouper 300, renderer 302, and post-mixer 303, respectively.

Relevant is the fact, that the significant matrices, values etc. are calculated individually for the respective groups of downmix signals 102. This implies that, e.g., the matrices to be computed are smaller than the matrices used in the state of art. The matrices have sizes depending on a number of input audio objects of the respective set of input audio objects associated with the groups of downmix signals and/or on a number of downmix signals belonging to the respective group of downmix signals.

In the state of art, the matrix to be used for the un-mixing has a size of the number of input audio objects or input audio signals times this number. The invention allows to compute a smaller matrix with a size depending on the number of input audio signals belonging to the respective group of downmix signals.

Figure 17:
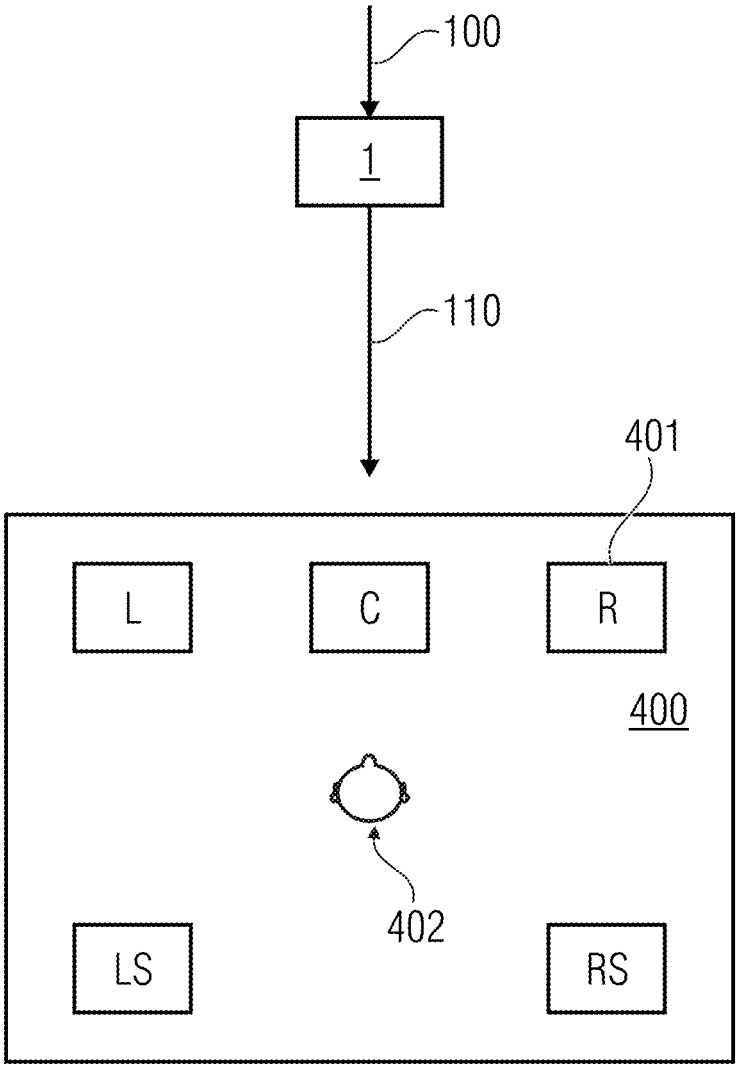
FIG. 17 shows schematically the application of an inventive apparatus.

In FIG. 17 the purpose of the rendering is explained.

The apparatus 1 receives an encoded audio signal 100 and decodes it providing a decoded audio signal 110.

This decoded audio signal 110 is played in a specific output situation or output scenario 400. The decoded audio signal 110 is in the example to be output by five loudspeakers 401: Left, Right, Center, Left Surround, and Right Surround. The listener 402 is in the middle of the scenario 400 facing the Center loudspeaker.

The renderer in the apparatus 1 distributes the reconstructed audio signals to be delivered to the individual loudspeakers 401 and, thus, to distribute a reconstructed representation of the original audio objects as sources of the audio signals in the given output situation 400.

The rendering, therefore, depends on the kind of output situation 400 and on the individual taste of preferences of the listener 402.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, one or more of the most important method steps may be executed by such an apparatus.

Depending on certain implementation requirements, embodiments of the invention can be implemented in hardware or in software or at least partially in hardware or at least partially in software. The implementation can be performed using a digital storage medium, for example a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitory.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

The apparatus described herein may be implemented using a hardware apparatus, or using a computer, or using a combination of a hardware apparatus and a computer.

The methods described herein may be performed using a hardware apparatus, or using a computer, or using a combination of a hardware apparatus and a computer.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

REFERENCES

[BCC] C. Faller and F. Baumgarte, "Binaural Cue Coding—Part II: Schemes and applications," IEEE Trans. on Speech and Audio Proc., vol. 11, no. 6, November 2003.

[ISS1] M. Parvaix and L. Girin: "Informed Source Separation of underdetermined instantaneous Stereo Mixtures using Source Index Embedding", IEEE ICASSP, 2010.

[ISS2] M. Parvaix, L. Girin, J.-M. Brossier: "A watermarking-based method for informed source separation of audio signals with a single sensor", IEEE Transactions on Audio, Speech and Language Processing, 2010.

[ISS3] A. Liutkus, J. Pinel, R. Badeau, L. Girin, G. Richard: "Informed source separation through spectrogram coding and data embedding", Signal Processing Journal, 2011.

[ISS4] A. Ozerov, A. Liutkus, R. Badeau, G. Richard: "Informed source separation: source coding meets source separation", IEEE Workshop on Applications of Signal Processing to Audio and Acoustics, 2011.

[ISS5] S. Zhang and L. Girin: "An Informed Source Separation System for Speech Signals", INTERSPEECH, 2011.

[ISS6] L. Girin and J. Pinel: "Informed Audio Source Separation from Compressed Linear Stereo Mixtures", AES 42nd International Conference: Semantic Audio, 2011.

[JSC] C. Faller, "Parametric Joint-Coding of Audio Sources", 120th AES Convention, Paris, 2006.

[SAOC] ISO/IEC, "MPEG audio technologies—Part 2: Spatial Audio Object Coding (SAOC)," ISO/IEC JTC1/SC29/WG11 (MPEG) International Standard 23003-2.

[SAOC1] J. Herre, S. Disch, J. Hilpert, O. Hellmuth: "From SAC To SAOC—Recent Developments in Parametric Coding of Spatial Audio", 22nd Regional UK AES Conference, Cambridge, UK, April 2007.

[SAOC2] J. Engdegård, B. Resch, C. Falch, O. Hellmuth, J. Hilpert, A. Hölzer, L. Terentiev, J. Breebaart, J. Koppens, E. Schuijers and W. Oomen: "Spatial Audio Object Coding (SAOC)—The Upcoming MPEG Standard on Parametric Object Based Audio Coding", 124th AES Convention, Amsterdam 2008.

[SAOC3D] ISO/IEC, JTC1/SC29/WG11 N14747, Text of ISO/MPEG 23008-3/DIS 3D Audio, Sapporo, July 2014.

[SAOC3D2] J. Herre, J. Hilpert, A. Kuntz, and J. Plogsties, "MPEG-H Audio—The new standard for universal spatial/3D audio coding," 137th AES Convention, Los Angeles, 2011.

The invention claimed is:

1. An apparatus for processing an encoded audio signal comprising a plurality of downmix signals associated with a plurality of input audio objects and object parameters, comprising:

a grouper configured to group said plurality of downmix signals into a plurality of groups of downmix signals associated with a set of input audio objects of said plurality of input audio objects, a processor configured to perform at least one processing step individually on the object parameters of each set of input audio objects in order to provide group results, and a combiner configured to combine said group results or processed group results in order to provide a decoded audio signal, wherein said grouper is configured to group said plurality of downmix signals into said plurality of groups of downmix signals so that each input audio object of each set of input audio objects either is free from a relation signaled in the encoded audio signal with other input audio objects or has a relation signaled in the encoded audio signal only with at least one input audio object belonging to the same set of input audio objects, or wherein said grouper is configured to group said plurality of downmix signals into said plurality of groups of downmix signals so that each input audio object of said plurality of input audio objects belongs to just one set of input audio objects, or wherein said grouper is configured to group said plurality of downmix signals into said plurality of groups of downmix signals using: detecting whether a downmix signal is assigned to an existing group of downmix signals; detecting whether at least one input audio object of the plurality of input audio objects associated with the downmix signal is part of a set of input audio objects associated with an existing group of downmix signals; assigning the downmix signal to a new group of downmix signals in case the downmix signal is free from an assignment to an existing group of downmix signals and in case all input audio objects of the plurality of input audio objects associated with the downmix signal are free from an association with an existing group of downmix signals; and combining the downmix signal with an existing group of downmix signals either in case the downmix signal is assigned to the existing group of downmix signals or in case at least one input audio object of the plurality of input audio objects associated with the downmix signal is associated with the existing group of downmix signals.

2. The apparatus of claim 1, wherein said grouper is configured to group said plurality of downmix signals into said plurality of groups of downmix signals while minimizing a number of downmix signals within each group of downmix signals.

3. The apparatus of claim 1, wherein said grouper is configured to group said plurality of downmix signals into said plurality of groups of downmix signals so that just one single downmix signal belongs to one group of downmix signals.

4. The apparatus of claim 1, wherein said grouper is configured to group said plurality of downmix signals into said plurality of groups of downmix signals based on information within said encoded audio signal.

5. The apparatus of claim 1, wherein said processor is configured to perform various processing steps individually on the object parameters of each set of input audio objects in order to provide individual matrices as group results, and wherein said combiner is configured to combine said individual matrices.

6. The apparatus of claim 1, wherein said processor is configured to perform at least one processing step individually on the object parameters of each set of input audio objects in order to provide individual matrices, wherein said apparatus comprises a post-processor configured to process jointly object parameters in order to provide at least one overall matrix, and wherein said combiner is configured to combine said individual matrices and said at least one overall matrix.

7. The apparatus of claim 1, wherein said processor comprises a calculator configured to compute individually for each group of downmix signals matrices with sizes depending on at least one of a number of input audio objects of the set of input audio objects associated with the respective group of downmix signals and a number of downmix signals belonging to the respective group of downmix signals.

8. The apparatus of claim 1, wherein processor is configured to compute for each group of downmix signals an individual threshold based on a maximum energy value within the respective group of downmix signals.

9. The apparatus of claim 1, wherein said combiner is configured to determine a post-mixing matrix based on the individually determined matrices for each group of downmix signals and wherein said combiner is configured to apply the post-mixing matrix to the plurality of downmix signals in order to acquire the decoded audio signal.

10. An apparatus for processing an encoded audio signal comprising a plurality of downmix signals associated with a plurality of input audio objects and object parameters, comprising:

a grouper configured to group said plurality of downmix signals into a plurality of groups of downmix signals associated with a set of input audio objects of said plurality of input audio objects, a processor configured to perform at least one processing step individually on the object parameters of each set of input audio objects in order to provide group results, and a combiner configured to combine said group results or processed group results in order to provide a decoded audio signal, wherein said processor is configured to determine an individual downmixing matrix for each group of downmix signals, to determine an individual group covariance matrix for each group of downmix signals, to determine an individual group downmix covariance matrix for each group of downmix signals based on the individual downmixing matrix and the individual group covariance matrix, and to determine an individual regularized inverse group matrix for each group of downmix signals, or wherein said processor is configured to determine an individual group rendering matrix for each group of downmix signals, and to determine an individual upmixing matrix for each group of downmix signals based on the individual group rendering matrix and the individual group parametric un-mixing matrix, and wherein said combiner is configured to combine the individual upmixing matrices to acquire an overall upmixing matrix, or wherein said processor is configured to determine an individual group rendering matrix for each group of downmix signals, and to determine an individual group covariance matrix for each group of downmix signals based on the individual group rendering matrix and the individual group covariance matrix, and wherein said combiner is configured to combine the individual group covariance matrices to acquire an overall group covariance matrix, or wherein said processor is configured to determine an individual group rendering matrix for each group of downmix signals, and to determine an individual group covariance matrix of the parametrically estimated signal based on the individual group rendering matrix, the individual group parametric un-mixing matrix, the individual downmixing matrix, and the individual group covariance matrix, and wherein said combiner is configured to combine the individual group covariance matrices of the parametrically estimated signal to acquire an overall parametrically estimated signal, or wherein said processor is configured to determine a regularized inverse matrix based on a singular value decomposition of a downmix covariance matrix, or wherein said processor is configured to determine for a determination of a parametric un-mixing matrix submatrix by selecting elements corresponding to the downmix signals assigned to the respective group k of downmix signals.

11. The apparatus of claim 10, wherein said combiner is configured to combine the individual regularized inverse group matrices $J_k$ to acquire an overall regularized inverse group matrix J.

12. The apparatus of claim 10, wherein said processor is configured to determine an individual group parametric un-mixing matrix for each group of downmix signals based on the individual downmixing matrix, the individual group covariance matrix, and the individual regularized inverse group matrix, and wherein said combiner is configured to combine the an individual group parametric un-mixing matrix to acquire an overall group parametric un-mixing matrix.

13. The apparatus of claim 12, wherein said processor is configured to determine an individual group parametric un-mixing matrix for each group of downmix signals based on the individual downmixing matrix, the individual group covariance matrix, and the individual regularized inverse group matrix, and wherein said combiner is configured to combine the individual group parametric un-mixing matrix to acquire an overall group parametric un-mixing matrix.

14. A method for processing an encoded audio signal comprising a plurality of downmix signals associated with a plurality of input audio objects and object parameters, said method comprising:

grouping said downmix signals into a plurality of groups of downmix signals associated with a set of input audio objects of said plurality of input audio objects, performing at least one processing step individually on the object parameters of each set of input audio objects in order to provide group results, and combining said group results in order to provide a decoded audio signal, wherein the grouping is performed so that each input audio object of each set of input audio objects either is free from a relation signaled in the encoded audio signal with other input audio objects or has a relation signaled in the encoded audio signal only with at least one input audio object belonging to the same set of input audio objects, or wherein the grouping is performed so that each input audio object of said plurality of input audio objects belongs to just one set of input audio objects, or wherein said grouping comprises: detecting whether a downmix signal is assigned to an existing group of downmix signals; detecting whether at least one input audio object of the plurality of input audio objects associated with the downmix signal is part of a set of input audio objects associated with an existing group of downmix signals; assigning the downmix signal to a new group of downmix signals in case the downmix signal is free from an assignment to an existing group of downmix signals and in case all input audio objects of the plurality of input audio objects associated with the downmix signal are free from an association with an existing group of downmix signals; and combining the downmix signal with an existing group of downmix signals either in case the downmix signal is assigned to the existing group of downmix signals or in case at least one input audio object of the plurality of input audio objects associated with the downmix signal is associated with the existing group of downmix signals.

15. Non-transitory storage medium having stored thereon a computer program for performing, when running on a computer or a processor, a method for processing an encoded audio signal comprising a plurality of downmix signals associated with a plurality of input audio objects and object parameters, said method comprising: grouping said downmix signals into a plurality of groups of downmix signals associated with a set of input audio objects of said plurality of input audio objects, performing at least one processing step individually on the object parameters of each set of input audio objects in order to provide group results, and combining said group results in order to provide a decoded audio signal, wherein the grouping is performed so that each input audio object of each set of input audio objects either is free from a relation signaled in the encoded audio signal with other input audio objects or has a relation signaled in the encoded audio signal only with at least one input audio object belonging to the same set of input audio objects, or wherein the grouping is performed so that each input audio object of said plurality of input audio objects belongs to just one set of input audio objects, or wherein said grouping comprises: detecting whether a downmix signal is assigned to an existing group of downmix signals; detecting whether at least one input audio object of the plurality of input audio objects associated with the downmix signal is part of a set of input audio objects associated with an existing group of downmix signals; assigning the downmix signal to a new group of downmix signals in case the downmix signal is free from an assignment to an existing group of downmix signals and in case all input audio objects of the plurality of input audio objects associated with the downmix signal are free from an association with an existing group of downmix signals; and combining the downmix signal with an existing group of downmix signals either in case the downmix signal is assigned to the existing group of downmix signals or in case at least one input audio object of the plurality of input audio objects associated with the downmix signal is associated with the existing group of downmix signals.

16. A method for processing an encoded audio signal comprising a plurality of downmix signals associated with a plurality of input audio objects and object parameters, said method comprising:

grouping said downmix signals into a plurality of groups of downmix signals associated with a set of input audio objects of said plurality of input audio objects, performing at least one processing step individually on the object parameters of each set of input audio objects in order to provide group results, and combining said group results in order to provide a decoded audio signal, wherein the performing comprises determining an individual downmixing matrix for each group of downmix signals, determining an individual group covariance matrix for each group of downmix signals, determining an individual group downmix covariance matrix for each group of downmix signals based on the individual downmixing matrix and the individual group covariance matrix, and determining an individual regularized inverse group matrix for each group of downmix signals, or wherein the performing comprises determining an individual group rendering matrix for each group of downmix signals, and determining an individual upmixing matrix for each group of downmix signals based on the individual group rendering matrix and the individual group parametric un-mixing matrix, and wherein the combining comprises combining the individual upmixing matrices to acquire an overall upmixing matrix, or wherein the performing comprises determining an individual group rendering matrix for each group of downmix signals, and determining an individual group covariance matrix for each group of downmix signals based on the individual group rendering matrix and the individual group covariance matrix, and wherein the combining comprises combining the individual group covariance matrices to acquire an overall group covariance matrix, or wherein the performing comprises determining to determining an individual group covariance matrix of the parametrically estimated signal based on the individual group rendering matrix, the individual group parametric un-mixing matrix, the individual downmixing matrix, and the individual group covariance matrix, and wherein the combining comprises combining the individual group covariance matrices of the parametrically estimated signal to acquire an overall parametrically estimated signal, or wherein the performing comprises determining a regularized inverse matrix based on a singular value decomposition of a downmix covariance matrix, or wherein the performing comprises determining of a parametric un-mixing matrix sub-matrix by selecting elements corresponding to the downmix signals assigned to the respective group k of downmix signals.

17. Non-transitory storage medium having stored thereon a computer program for performing, when running on a computer or a processor, a method for processing an encoded audio signal comprising a plurality of downmix signals associated with a plurality of input audio objects and object parameters, said method comprising: grouping said downmix signals into a plurality of groups of downmix signals associated with a set of input audio objects of said plurality of input audio objects, performing at least one processing step individually on the object parameters of each set of input audio objects in order to provide group results, and combining said group results in order to provide a decoded audio signal, wherein the performing comprises determining an individual downmixing matrix for each group of downmix signals, determining an individual group covariance matrix for each group of downmix signals, determining an individual group downmix covariance matrix for each group of downmix signals based on the individual downmixing matrix and the individual group covariance matrix, and determining an individual regularized inverse group matrix for each group of downmix signals, or wherein the performing comprises determining an individual group rendering matrix for each group of downmix signals, and determining an individual upmixing matrix for each group of downmix signals based on the individual group rendering matrix and the individual group parametric un-mixing matrix, and wherein the combining comprises combining the individual upmixing matrices to acquire an overall upmixing matrix, or wherein the performing comprises determining an individual group rendering matrix for each group of downmix signals, and determining an individual group covariance matrix for each group of downmix signals based on the individual group rendering matrix and the individual group covariance matrix, and wherein the combining comprises combining the individual group covariance matrices to acquire an overall group covariance matrix, or wherein the performing comprises determining to determining an individual group covariance matrix of the parametrically estimated signal based on the individual group rendering matrix, the individual group parametric un-mixing matrix, the individual downmixing matrix, and the individual group covariance matrix, and wherein the combining comprises combining the individual group covariance matrices of the parametrically estimated signal to acquire an overall parametrically estimated signal, or wherein the performing comprises determining a regularized inverse matrix based on a singular value decomposition of a downmix covariance matrix, or wherein the performing comprises determining of a parametric un-mixing matrix sub-matrix by selecting elements corresponding to the downmix signals assigned to the respective group k of downmix signals.

* * * * *